US012023571B2

(12) United States Patent
Sabol

(10) Patent No.: US 12,023,571 B2
(45) Date of Patent: Jul. 2, 2024

(54) ROTATABLE SPORTS-BOARD BINDING ADAPTER WITH TRANSLATABLE LOW-FRICTION PUCKS

(71) Applicant: Jeffrey P. Sabol, Indian Hills, CO (US)

(72) Inventor: Jeffrey P. Sabol, Indian Hills, CO (US)

( * ) Notice: Subject to any disclaimer, the term of this patent is extended or adjusted under 35 U.S.C. 154(b) by 461 days.

(21) Appl. No.: 16/679,781

(22) Filed: Nov. 11, 2019

(65) Prior Publication Data

US 2020/0164264 A1 May 28, 2020

Related U.S. Application Data

(60) Provisional application No. 62/772,286, filed on Nov. 28, 2018.

(51) Int. Cl.

| | |
|---|---|
| ***A63C 10/18*** | (2012.01) |
| ***A63C 9/02*** | (2012.01) |
| ***A63C 9/081*** | (2012.01) |
| ***A63C 10/12*** | (2012.01) |
| ***A63C 10/14*** | (2012.01) |

(52) U.S. Cl.

CPC ..... *A63C 9/081* (2013.01); *A63C 9/02* (2013.01); *A63C 10/12* (2013.01); *A63C 10/14* (2013.01); *A63C 10/18* (2013.01)

(58) Field of Classification Search

CPC ..... A63C 10/16; A63C 10/18; A63C 10/26; A63C 2203/20; A63C 9/081; A63C 10/12; A63C 10/14

See application file for complete search history.

(56) References Cited

U.S. PATENT DOCUMENTS

| | | | | |
|---|---|---|---|---|
| 3,915,466 | A | 10/1975 | Matsuda | |
| 4,008,910 | A | 2/1977 | Roche | |
| 4,712,318 | A * | 12/1987 | Greiner | A43C 15/161 36/134 |
| 4,741,550 | A * | 5/1988 | Dennis | A63C 10/26 280/14.23 |
| 4,788,746 | A | 12/1988 | Idler | |
| 4,846,013 | A | 7/1989 | Iwasaki | |
| 4,993,280 | A | 2/1991 | Olkoski et al. | |
| 5,020,518 | A | 6/1991 | Spears et al. | |

(Continued)

FOREIGN PATENT DOCUMENTS

| | | |
|---|---|---|
| CH | 678278 | 8/1991 |
| JP | 2000-70432 | 3/2000 |
| WO | WO 96/12532 | 5/1996 |

*Primary Examiner* — Jeffrey J Restifo

(74) *Attorney, Agent, or Firm* — Cozen O'Connor

(57) ABSTRACT

A rotatable sports-board binding adapter mounts to a sports board and allows a user to adjust an angle of one foot relative to the sports board. The adapter includes a base plate forming a series of lock holes and at least one pocket that accommodates a low-friction puck. A rotatable plate connects to the base plate and includes a locking mechanism that can engage with any one of the lock holes to prevent rotation of the rotatable plate. When the low-friction puck is inserted into the pocket, the puck is translatable so that it contacts the rotatable plate, advantageously preventing the rotatable plate and base plate from directly contacting each other while providing a low-friction surface that enables the rotatable plate to easily rotate with respect to the base plate. As the low-friction puck wears, it may be additionally translated, or replaced with a new puck.

20 Claims, 18 Drawing Sheets

(56) References Cited

U.S. PATENT DOCUMENTS 5,054,807 A 10/1991 Fauvet
5,354,088 A * 10/1994 Vetter ..... A63C 10/18 280/14.22
5,362,056 A 11/1994 Minotti
5,577,755 A * 11/1996 Metzger ..... A63C 10/14 280/607
5,586,779 A * 12/1996 Dawes ..... A63C 10/18 280/607
5,667,237 A * 9/1997 Lauer ..... A63C 10/18 280/607
5,762,358 A * 6/1998 Hale ..... A63C 10/18 280/607
5,803,481 A * 9/1998 Eaton ..... A63C 10/18 280/620
5,820,155 A 10/1998 Brisco
5,822,890 A * 10/1998 Beitel ..... A43C 15/161 36/134
5,832,784 A 11/1998 McCallips et al.
5,897,128 A * 4/1999 McKenzie ..... A63C 10/14 280/607
5,913,530 A * 6/1999 Berger ..... A63C 10/10 280/607
5,923,241 A 7/1999 Cascan-Garvalos
6,007,085 A 12/1999 Rigal et al.
6,022,041 A * 2/2000 Dailey ..... A63C 10/14 280/618
6,062,584 A * 5/2000 Sabol ..... A63C 10/14 280/607
6,102,430 A * 8/2000 Reynolds ..... A63C 10/18 280/618
6,155,591 A 12/2000 Huffman et al.
6,203,051 B1 * 3/2001 Sabol ..... A63C 10/18 280/607
6,234,494 B1 5/2001 Gien
6,272,964 B1 8/2001 Heilshov
6,315,305 B1 11/2001 Gien
6,318,749 B1 * 11/2001 Eglitis ..... A63C 10/14 280/607
6,450,511 B1 * 9/2002 LaVoy ..... A63C 10/18 280/14.22
6,491,310 B1 * 12/2002 Work ..... A63C 10/28 280/626
6,575,489 B1 * 6/2003 White ..... A63C 10/18 280/634
6,655,700 B1 * 12/2003 Caputo ..... A63C 10/106 280/14.22
6,753,635 B2 6/2004 Kuhlmann-Wilsdorf
7,073,813 B2 * 7/2006 Martin ..... A63C 10/106 36/117.3
7,097,195 B2 * 8/2006 Orr ..... A63C 10/285 280/628
2002/0024187 A1 * 2/2002 Gyr ..... A63C 5/07 280/14.22
2002/0089129 A1 * 7/2002 Aiken ..... A63C 10/26 280/623
2003/0230870 A1 * 12/2003 Sabol ..... A63C 10/14 280/618
2004/0100069 A1 * 5/2004 Cumby ..... A63C 10/14 280/618
2004/0145152 A1 * 7/2004 Santa Cruz ..... A63C 5/03 280/602
2004/0188983 A1 * 9/2004 Scholten ..... A63C 10/18 280/14.24
2004/0262862 A1 * 12/2004 Orr ..... A63C 10/18 280/14.24
2005/0034853 A1 2/2005 Robichaux et al.
2005/0051978 A1 * 3/2005 Sabol ..... A63C 10/14 280/14.24
2006/0091622 A1 * 5/2006 Sabol ..... A63C 9/02 280/14.24
2006/0226613 A1 * 10/2006 Wilson ..... A63C 5/07 280/14.22
2007/0114737 A1 * 5/2007 Lindemann ..... A63C 10/14 280/14.23
2020/0164264 A1 * 5/2020 Sabol ..... A63C 9/081

* cited by examiner

ROTATABLE SPORTS-BOARD BINDING ADAPTER WITH TRANSLATABLE LOW-FRICTION PUCKS

RELATED APPLICATIONS

This application claims priority to U.S. Provisional Patent Application No. 62/772,286, filed Nov. 28, 2018, the entirety of which is incorporated herein by reference.

BACKGROUND

Sports boards may be used in sky, ground, water, ice, and snow-related sports. Examples of sports boards include waterboards, snowboards, wakeboards, skateboards, surfboards, sailboards and skateboard-type devices adapted for use on ice surfaces. Sports boards typically use bindings to hold shoes or boots of a user.

SUMMARY OF THE EMBODIMENTS

Sports-board bindings are normally affixed to a sports board such that the user's feet are oriented perpendicularly to a forward direction of travel of the sports board. This conventional orientation may not be comfortable for all types of sports-board activity. For example, the conventional orientation may be acceptable for riding downhill on a snowboard, but uncomfortable when traveling over a flat or uphill snow contour, when it may be necessary to release the back boot from its binding and use that boot to propel the snowboard forward. Having the front boot oriented perpendicularly to the snowboard when the snowboard and back foot move forward may be dangerous because a fall in this orientation may injure an ankle or knee joints of the user. Furthermore, on a chairlift, the conventional orientation causes the snowboard to be positioned across the front of the chair, which may make mounting and dismounting the chairlift awkward and may disturb or interfere with an adjacently seated rider.

The present embodiments include a rotatable sports-board binding adapter that advantageously allows a user to adjust an angle of their foot with respect to a sports board, and thus use the sports board with various orientations of their feet. The user may use two such adapters with one sports board to independently adjust the angle of each of their two feet relative to the sports board. For example, the user may prefer to lock both of their feet in a forward orientation (e.g., 10° with respect to the forward direction of travel) for speed runs. Alternatively, the user may prefer to lock their feet at 45° for cruise runs, or 85° for technical runs (e.g., down a half pipe). The rotatable sports-board binding adapter also advantageously allows the user to rotate one or both feet to a more comfortable stance while waiting for, or riding on, a chairlift.

In an embodiment, a rotatable sports-board binding adapter includes a base plate forming a series of lock holes and at least one pocket configured to accommodate a low-friction puck. The rotatable sports-board binding adapter also includes a rotatable plate connected to the base plate to rotate about a rotation axis, and having at least one locking mechanism configured to engage any one of the lock holes. When inserted into the at least one pocket, the low-friction puck is translatable along a depth direction, parallel to the rotation axis, of the at least one pocket to contact the rotatable plate.

Low-friction pucks advantageously prevent the rotatable plate and base plate from directly contacting each other, which could result in galling of surfaces or other damage. At the same time, low-friction pucks allow the rotatable and base plates to easily rotate with respect to each other. As each low-friction puck wears, it may be additionally translated along the depth direction. For example, the base plate may form a threaded hole beneath the at least one pocket such that a puck set screw translatable along the threaded hole contacts a bottom face of the low-friction puck to push the top face of the low-friction puck against the rotatable plate. When each low-friction puck is sufficiently worn, it may be replaced with a new low-friction puck.

In another embodiment, a method for adjusting friction of a rotatable sports-board binding adapter includes translating a low-friction puck along a depth direction of a pocket formed by a base plate to force a top face of the low-friction puck against a plate rotatably connected to the base plate. Translating may include rotating a puck set screw in a threaded hole formed by the base plate beneath the pocket to push the puck set screw against a bottom face of the low-friction puck.

In another embodiment, a rotatable sports-board binding adapter includes a base plate forming a series of lock holes, and a rotatable plate (i) connected to the base plate to rotate about a rotation axis, (ii) having at least one locking mechanism configured to engage any one of the lock holes, and (iii) forming at least one pocket configured to accommodate a low-friction puck. When inserted into the at least one pocket, the low-friction puck is translatable along a depth direction, parallel to the rotation axis, of the at least one pocket to contact the base plate. The rotatable plate may form a threaded hole above the at least one pocket such that a puck set screw translatable along the threaded hole contacts a top face of the low-friction puck to push the bottom face of the low-friction puck against the base plate.

DETAILED DESCRIPTION OF THE EMBODIMENTS

Figure 1:
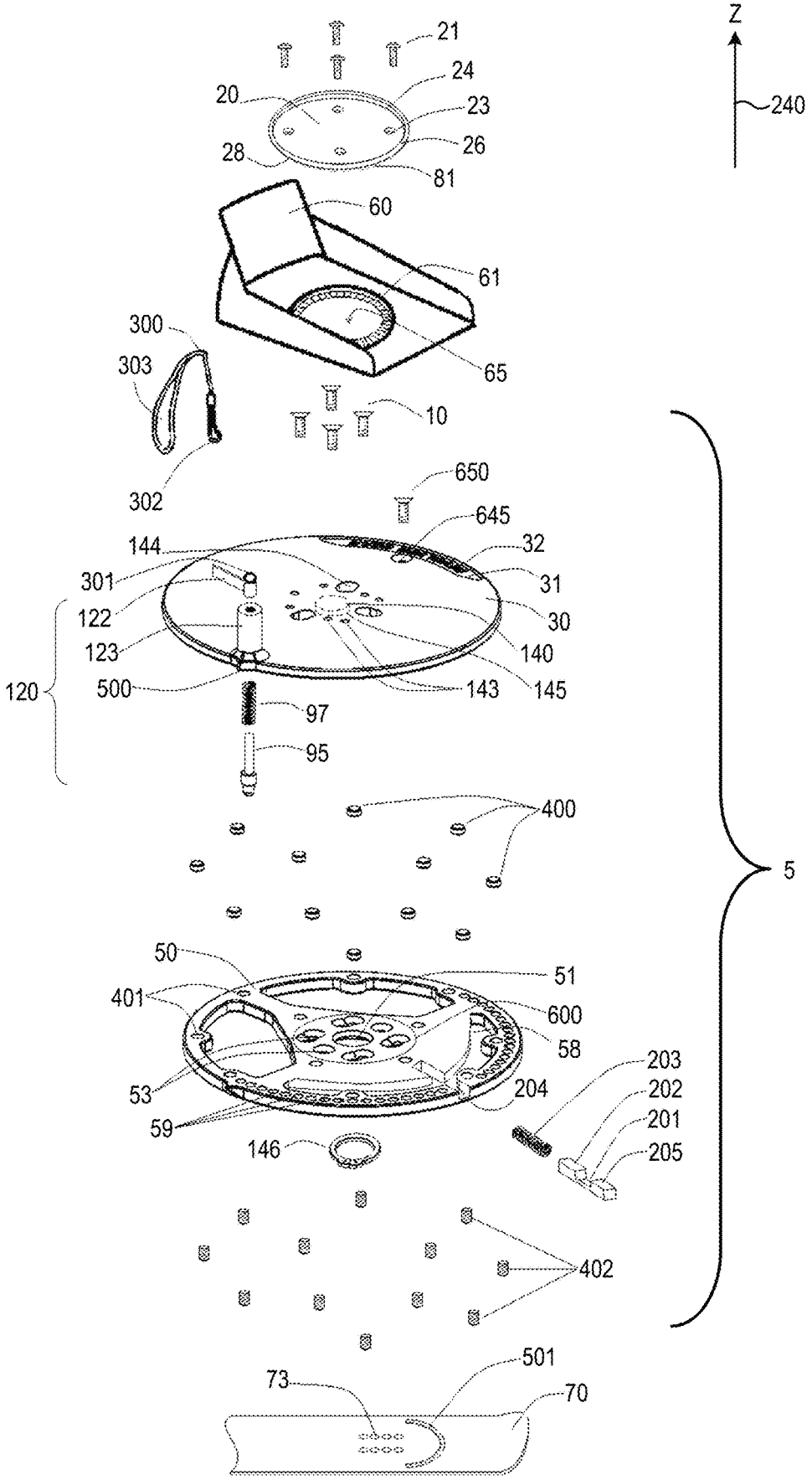
FIG. 1 is an exploded view of a rotatable sports-board binding adapter that mounts between a boot binding and a sports board, in embodiments.

FIG. 1 is an exploded view of a rotatable sports-board binding adapter 5 that mounts between a boot binding 60 and a sports board 70. Adapter 5 has a rotatable plate 30 that connects to a base plate 50 via a cylindrical post 140 that extends downward from rotatable plate 30. Thus, plate 30 is rotatable, with respect to base plate 50, about a vertical rotation axis defined by cylindrical post 140 and parallel to a z-direction 240. Base plate 50 forms mounting holes 53 for mounting via mounting screws 10 to a corresponding set of holes 73 in sports board 70. A cap plate 20 may secure boot binding 60 to rotatable plate 30 such that boot binding 60 and rotatable plate 30 are fixed relative to each other. Thus, when rotatable plate 30 rotates with respect to base plate 50, a sports boot affixed to binding 60 rotates likewise.

In FIG. 1, base plate 50 forms pockets 401 that accommodate translatable low-friction pucks 400 that reduce and/or control friction between base plate 50 and rotatable plate 30. Use of low-friction pucks 400, and a finish of rotatable plate 30 and/or base plate 50, provides control over a torque required to rotate plate 30 with respect to plate 50. For example, a snowboarder may find it inconvenient to rotate plate 30 with respect to plate 50 if the torque required to do so is greater than about 10 N·m. Conversely, the snowboarder may find it hard to control rotation of plate 30 with respect to plate 50 if the torque required to do so is less than about 0.05 N·m. In one embodiment, therefore, rotatable sports-board binding adapter 5 is configured such that a torque between 0.1 and 5 N·m can rotate plate 30 with respect to plate 50. In another embodiment, which provides an even more comfortable range of torque for a user thereof, rotatable sports-board binding adapter 5 is configured such that a torque between 0.3 and 3 N·m can rotate plate 30 with respect to plate 50.

Figure 2:
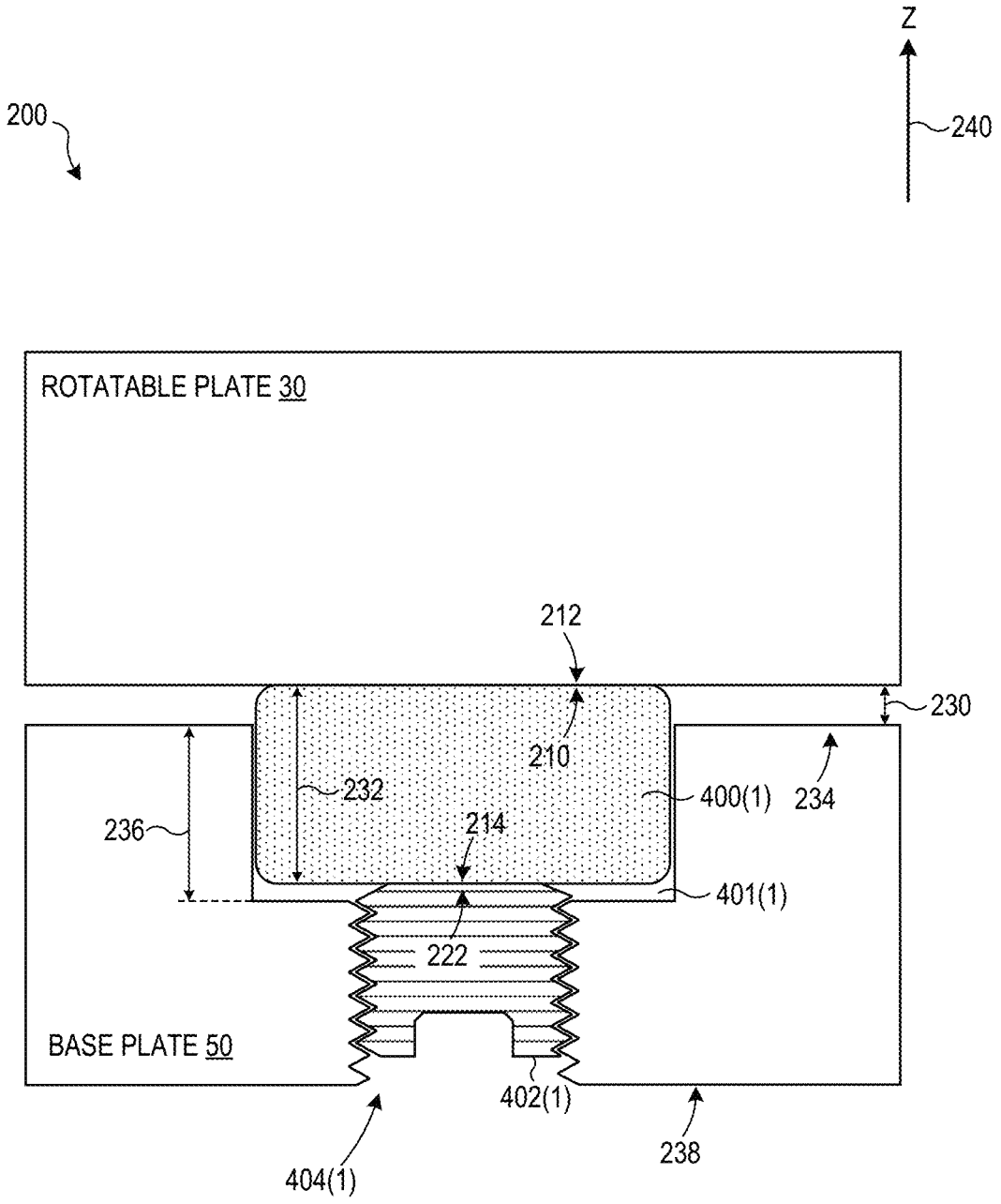
FIG. 2 is a side cut-away view of one puck, of translatable low-friction pucks of FIG. 1, inserted into one pocket, of pockets of FIG. 1, in embodiments.

FIG. 2 is a side cut-away view 200 of one puck 400(1), of translatable low-friction pucks 400 of FIG. 1, inserted into one pocket 401(1), of pockets 401 of FIG. 1. A tip 222 of a set screw 402(1) pushes upward against a bottom face 214 of puck 400(1), positioning puck 400(1) such that a top face 210 of puck 400(1) extends above a top surface 234 of base plate 50 to contact a bottom surface 212 of rotatable plate 30. Thus, puck 400(1) creates a gap 230 that prevents bottom surface 212 of rotatable plate 30 from directly contacting top surface 234 of base plate 50. Pocket 401(1) is formed to a depth 236, measured along z-direction 240 and with respect to top surface 234 of base plate 50. For clarity herein, z-direction 240 may also be referred to as a depth direction.

Figure 3:
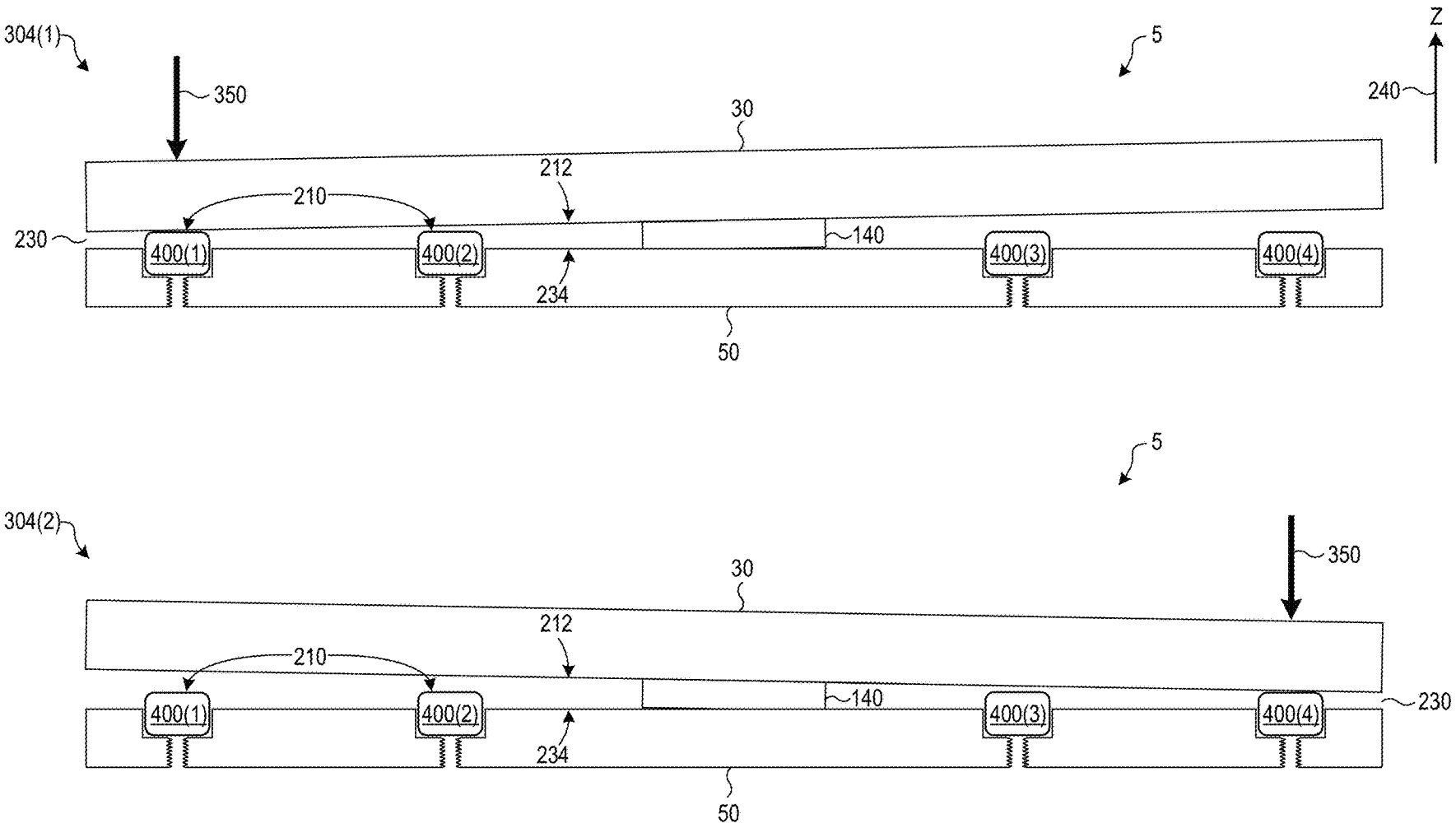
FIG. 3 shows first and second side cut-away views of the rotatable sports-board binding adapter of FIG. 1, illustrating how translation of the low-friction pucks of FIG. 1 advantageously prevents the rotatable plate of FIG. 1 from "wobbling" as a top face of each of the low-friction pucks wears away due to use of the rotatable sports-board binding adapter, in embodiments.

FIG. 3 shows first and second side cut-away views 304(1), 304(2) of rotatable sports-board binding adapter 5, illustrating how translation of low-friction pucks 400 advantageously prevents rotatable plate 30 from "wobbling" as top face 210 of each of low-friction pucks 400 wears away due to use of rotatable sports-board binding adapter 5. FIG. 3 shows four of low-friction pucks 400, each having a different puck length (see puck length 232 in FIG. 2). In first side cut-away view 304(1), a user of adapter 5 shifts his or her weight 350 over a first side of adapter 5, pushing the first side of rotatable plate 30 downward against a first low-friction puck 400(1). Thus, near puck 400(1), gap 230 decreases while near an opposing second side of adapter 5 (i.e., near a fourth low-friction puck 400(4)), gap 230 increases. In second side cut-away view 304(2), the user of adapter 5 shifts his or her weight 350 over the second side of adapter 5, pushing the second side of rotatable plate 30 downward against puck 400(4). Thus, near puck 400(4), gap 230 decreases while near the first side of adapter 5 (i.e., near first puck 400(1)), gap 230 increases.

Thus, FIG. 3 shows that as the user of adapter 5 shifts his or her weight 350 back-and-forth across adapter 5, rotatable plate 30 will "wobble" with respect to base plate 50. That is, bottom surface 212 of rotatable plate 30 and top surface 234 of base plate 50 may not remain parallel. Wobble of rotatable plate 30 may disadvantageously interfere with the user's ability to ride sports board 70 (e.g., maintain balance). Furthermore, as rotatable plate 30 wobbles, rotatable plate 30 may not physically contact all low-friction pucks 400, thereby changing the torque needed to rotate plate 30 with respect to plate 50 and accelerating additional and/or uneven wear of low-friction pucks 400. Thus, the user may find it hard to control rotation of plate 30 with respect to plate 50 when plate 30 wobbles.

Translation of low-friction pucks 400 may also advantageously help prevent rotatable plate 30 and base plate 50 from directly contacting each other. For example, in first side cut-away view 304(1) of FIG. 3, top face 210 of first low-friction puck 400(1) may wear away so much that rotatable plate 30 directly contacts base plate 50 at the first side of adapter 5, causing wear of bottom surface 212 and/or top surface 234 that creates debris that accelerates additional wear of bottom surface 212, top surface 234, low-friction pucks 400, cylindrical post 140 and/or other components of rotatable sports-board binding adapter 5. The wear may include galling of bottom surface 212 and top surface 234 that permanently damages rotatable plate 30 and/or base plate 50. Galling may also cause rotatable plate 30 to seize against base plate 50 such that rotatable plate 30 is no longer rotatable.

Figure 4:
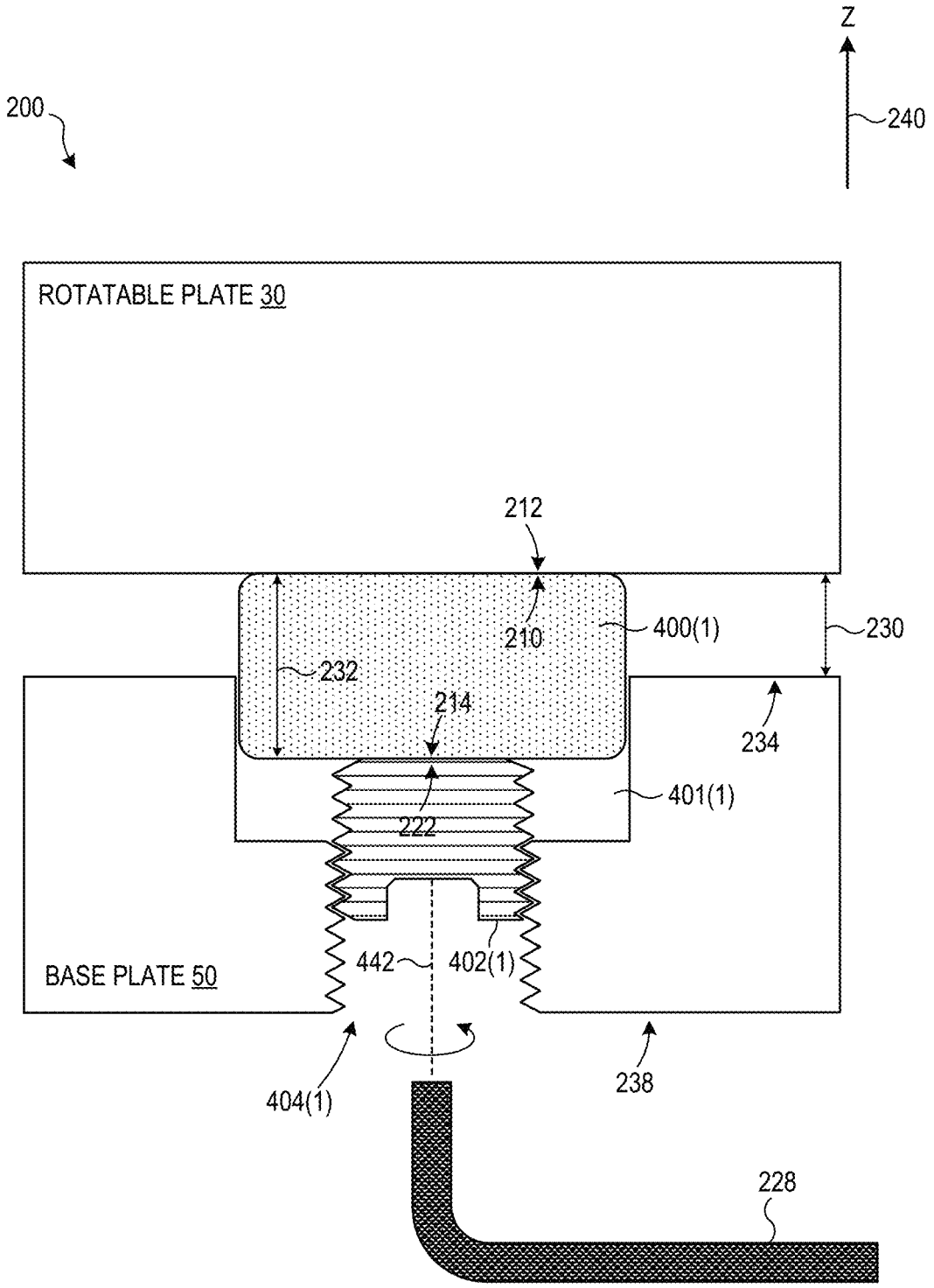
FIG. 4 shows the side cut-away view of FIG. 2 after the puck of FIG. 2 has been translated along a z-direction, in an embodiment.

FIG. 4 shows side cut-away view 200 of FIG. 2 after puck 400(1) has been translated along z-direction 240. Base plate 50 forms a threaded hole 404(1) beneath pocket 401(1) into which set screw 402(1) may be threaded and rotated to translate along threaded hole 404(1) (i.e., along z-direction 240). Set screw 402(1) may be rotated, for example, by an Allen key 228 about a rotation axis 442 of set screw 402(1) parallel to z-direction 240.

In FIG. 3, each of low-friction pucks 400 may be advanced along z-direction 240 similarly to puck 400(1) of FIG. 4. Each of low-friction pucks 400 may be advanced such that rotatable plate 30 does not wobble. In this case, gap 230 is uniform, i.e., bottom surface 212 of rotatable plate 30 and top surface 234 of base plate 50 are parallel.

A length of set screw 402(1) along z-direction 240 may be chosen such that no part of set screw 402(1) extends below a bottom surface 238 of base plate 50, thereby ensuring that base plate 50 sits flat on top of sports board 70. As length 232 of puck 400(1) decreases and set screw 402(1) is advanced along threaded hole 404(1), some threads of threaded hole 404(1) may no longer remain engaged with threads of set screw 402(1). Thus, in one embodiment, as length 232 of puck 400(1) decreases, set screw 402(1) is replaced with a longer set screw 402(1) that advantageously engages with more threads of threaded hole 404(1). As shown in FIGS. 2 and 4, tip 222 is a flat tip that contacts a larger area of bottom face 214 of puck 400(1) than a conical or oval tip. However, tip 222 may be any kind of set-screw tip (e.g., cup, dog, knurled cup) without departing from the scope hereof.

Figure 5:
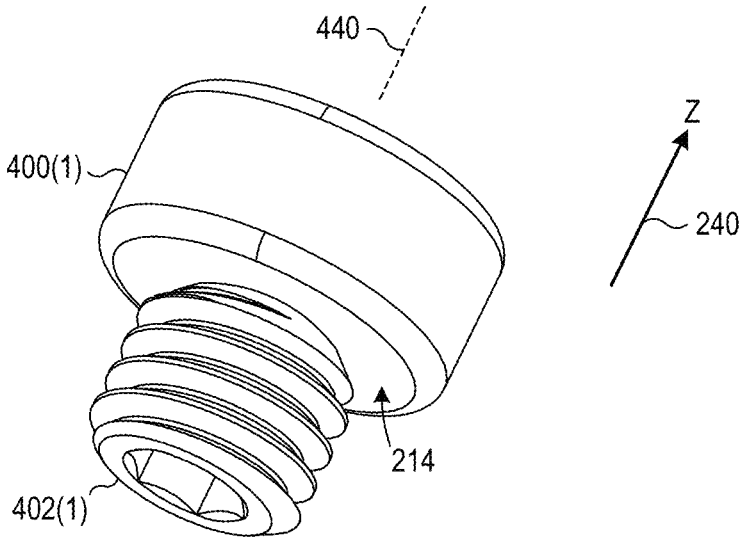
FIG. 5 is a perspective view of a set screw contacting a bottom face of the puck of FIG. 2, in an embodiment.

FIG. 5 is a perspective view of set screw 402(1) contacting bottom face 214 of puck 400(1). As shown, puck 400(1) has a cylindrical shape with a cylindrical axis 440 parallel to the depth direction (i.e., z-direction 240). However, puck 400(1) may have any shape without departing from the scope hereof.

Figure 6:
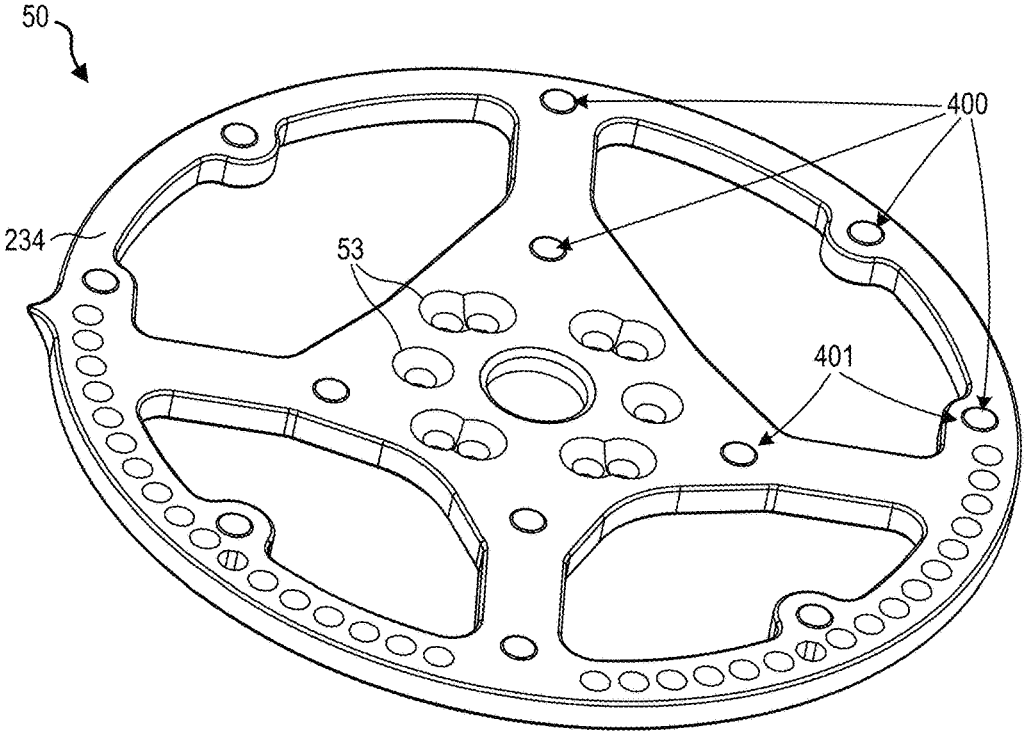
FIGS. 6 and 7 are perspective views of a top surface and a bottom surface, respectively, of the base plate of FIG. 1, in an embodiment.
Figure 7:
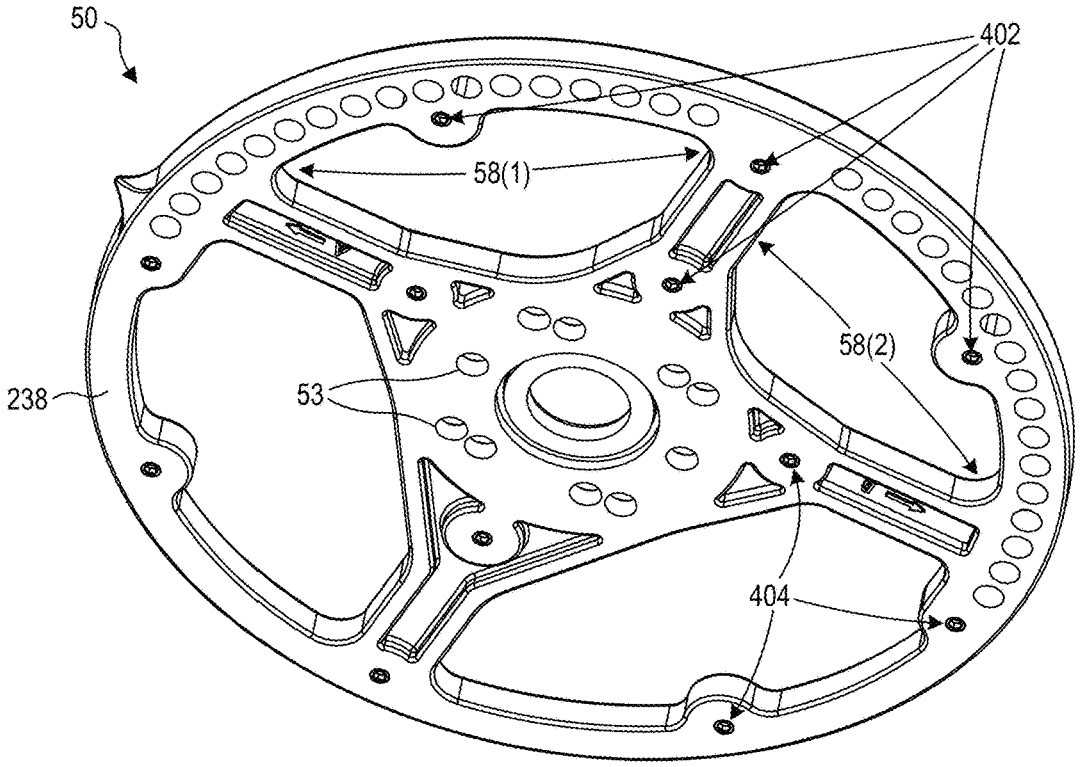

FIGS. 6 and 7 are perspective views of top surface 234 and bottom surface 238, respectively, of base plate 50. FIG. 6 shows low-friction pucks 400 inserted into pockets 401, and FIG. 7 shows set screws 402 inserted into threaded holes 404. FIGS. 6 and 7 illustrate one example of how low-friction pucks 400 may be distributed on base plate 50 such that gap 230 may be controlled across rotatable sports-board binding adapter 5. Each of threaded holes 404 is centered beneath one of pockets 401 such that each of set screws 402 is centered on bottom face 214 of one of low-friction pucks 400. While FIGS. 6 and 7 show base plate 50 with twelve low-friction pucks 400 and twelve set screws 402, base plate 50 may be configured with any number of pockets 401 and threaded holes 404 to accommodate said any number of low-friction pucks 400 and set screws 402, without departing from the scope hereof.

Figure 8:
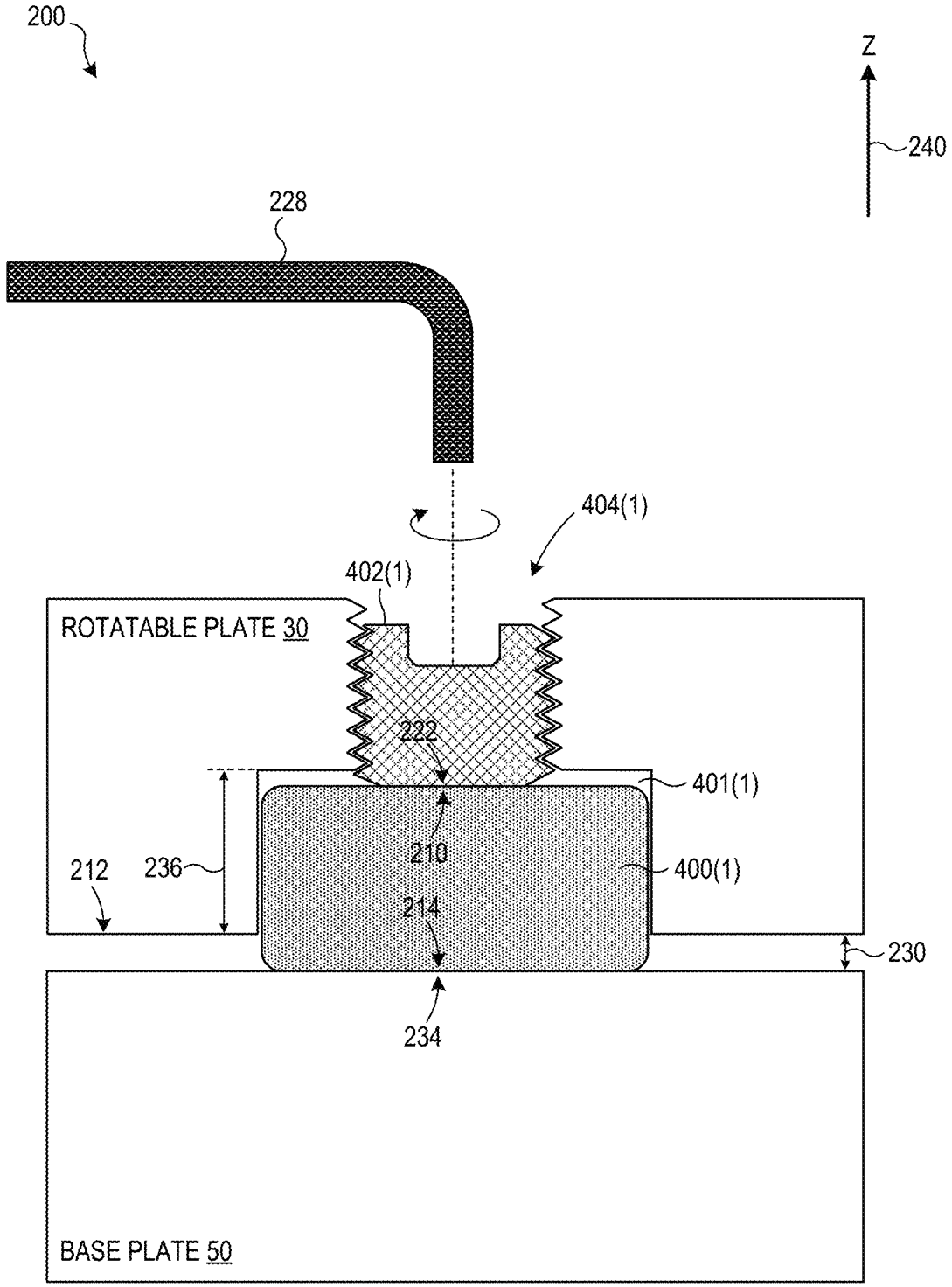
FIG. 8 is a side cut-away view of the puck of FIG. 2 inserted into the pocket of FIG. 2 formed by the rotatable plate of FIG. 1, in an embodiment.

FIG. 8 is a side cut-away view of puck 400(1) inserted into pocket 401(1) formed by rotatable plate 30. Tip 222 of set screw 402(1) pushes downward against top face 210 of puck 400(1), positioning puck 400(1) such that bottom face 214 of puck 400(1) extends below bottom surface 212 of rotatable plate 30 to contact top surface 234 of base plate 50. Pocket 401(1) is formed to depth 236, measured along z-direction 240 and with respect to bottom surface 212 of rotatable plate 30. Like the example of FIGS. 2 and 4, the example of FIG. 8 forms gap 230 to prevent top surface 234 of base plate 50 and bottom surface 212 of rotatable plate 30 from directly contacting each other.

After some of bottom face 214 of puck 400(1) wears away, puck 400(1) may be advanced against z-direction 240 (i.e., along a negative z-direction opposite z-direction 240) to prevent rotatable plate 30 from wobbling and to prevent direct contact of bottom surface 212 and top surface 234. Rotatable plate 30 forms a threaded hole 404(1) above pocket 401(1) into which set screw 402(1) may be threaded and rotated to translate along threaded hole 404(1) (i.e., against z-direction 240).

The example of FIG. 8 allows set screw 402(1) to be accessed (e.g., via Allen key 228) from above rotatable plate 30, advantageously allowing set screw 402(1) to be adjusted without having to remove rotatable sports-board binding adapter 5 from sports board 70. By contrast, the example of FIGS. 2 and 4, wherein set screw 402(1) is accessible only from below base plate 50, requires rotatable sports-board binding adapter 5 to be removed from sports board 70 to adjust set screw 402(1). In FIG. 8, threaded hole 404(1) may be covered (e.g., with a screw-cap cover or rubber hole plug) to prevent ingress of snow and/or unauthorized adjustment of set screw 402(1).

As low-friction pucks 400 wear away over time, thickness 232 of any one of low-friction pucks 400 may become too thin to ensure proper physical contact with rotatable plate 30. In this case, said any one of low-friction pucks 400 may be replaced with a new low-friction puck having a thickness 232 large enough to ensure mechanical rigidity and a sufficient size of gap 230.

Base plate 50 and rotatable plate 30 may be made, for example, of a non-rusting, durable material, such as metal (e.g., stainless steel, die cast aluminum), structurally durable molded or injected plastic, carbon fiber composite, or combinations thereof (e.g., plastic molded about a metal frame). Base plate 50 and rotatable plate 30 may include a microscopically smooth finish, such as nickel-molybdenum electroplating, to minimize wear of low-friction pucks 400.

The term "low-friction" herein denotes having a low coefficient of dynamic friction. A low-friction material generates low friction when it slides against an opposing surface, and excludes arrangements of moving parts that are not fixed to a sliding surface or an opposing surface (e.g., ball bearings). Low-friction pucks 400 may be made of polytetrafluoroethylene (PTFE), such as Teflon®. Alternatively, low-friction pucks 400 may be made of nylon, polyimide, polyoxymethylene (e.g., acetal), ceramic (e.g., aluminum magnesium boride), or any other material known to have a low coefficient of dynamic friction. Low-friction pucks 400 may be cylindrical, as shown in FIGS. 1 and 5, or may be shaped differently.

The torque required by a user to rotate plate 30 with respect to plate 50 also depends on a normal force acting on an interface between each of low-friction pucks 400 and rotatable plate 30. The normal force depends upon the weight of the user (e.g., weight 350 of FIG. 3), and thus a heavier user may need to provide a larger torque to rotate plate 30 with respect to plate 50, as compared to a lighter user. In addition, the normal force depends upon an angle that adapter 5 forms with respect to gravity. More specifically, a user riding on flat ground may need to provide a different torque to rotate plate 30 with respect to plate 50, as compared to riding down a steep incline.

In FIG. 1, cylindrical post 140 has an annular groove 145 that may receive a C-shaped spring clip 146 to connect rotatable plate 30 and base plate 50. Base plate 50 has a mating circular opening 51 for encircling cylindrical post 140; the underside of base plate 50 may have a recess 52 about circular opening 51 (recess 52 and circular opening 51 may be seen more clearly in FIG. 19) to accommodate spring clip 146. Rotatable plate 30 also has a set of access holes 144 that allow access to mounting holes 53 when mounting adapter 5 to sports board 70.

Binding 60 forms a circular opening 65. Cap plate 20 has an elevated peripheral rim 26 about a depression 24, and a downward protruding circular bottom 28 that is smaller in diameter than circular opening 65, so that circular bottom 28 of cap plate 20 may fit into circular opening 65 and contact rotatable plate 30. Cap plate 20 forms a set of holes 23 that accommodate cap plate screws 21 for securing cap plate 20 to rotatable plate 30. Rotatable plate 30 forms a set of threaded holes 143 that receive cap plate screws 21; threaded holes 143 may form patterns corresponding to industry standard layouts for bindings, such as a square four-hole pattern, a diamond four-hole pattern, and/or a three-hole triangle pattern. A set of top teeth 81 of cap plate 20 interlock with a set of bottom teeth 61 of binding 60, thereby locking binding 60 to rotatable plate 30.

Rotation Limiting

To promote safety, rotatable sports-board binding adapter 5 may also include one or more safety screws that limit an angle through which rotatable plate 30 and binding 60 may rotate relative to base plate 50 and sports board 70. Limiting the angle through which binding 60 may rotate relative to sports board 70 may advantageously prevent overextension of knee and/or ankle joints of a user of sports board 70 when the user pushes sports board 70 along flat or uphill terrain, and/or mounts or dismounts a chairlift.

Figure 9:
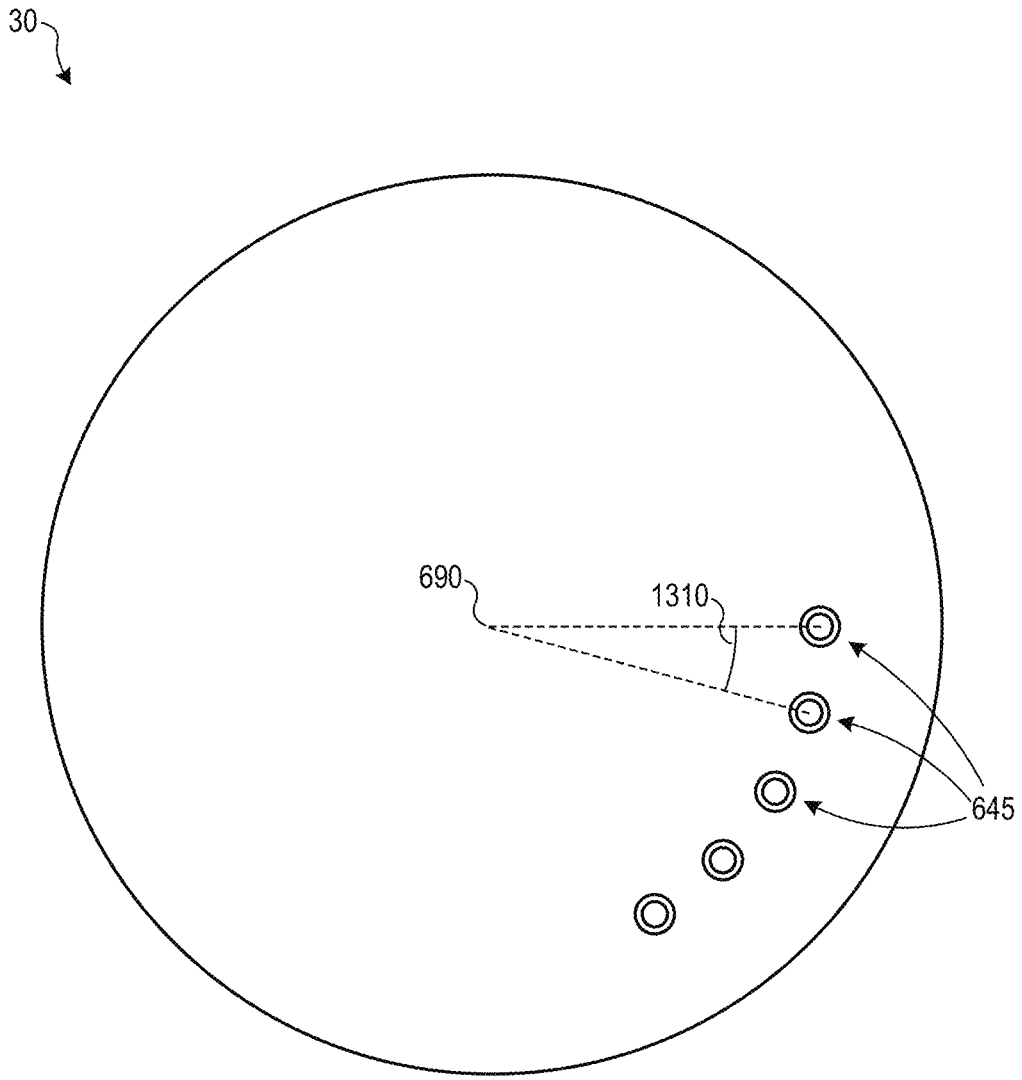
FIG. 9 is a top view of the rotatable plate of FIG. 1 showing one example of how the rotatable plate forms a plurality of safety-screw holes, in an embodiment.
Figure 10:
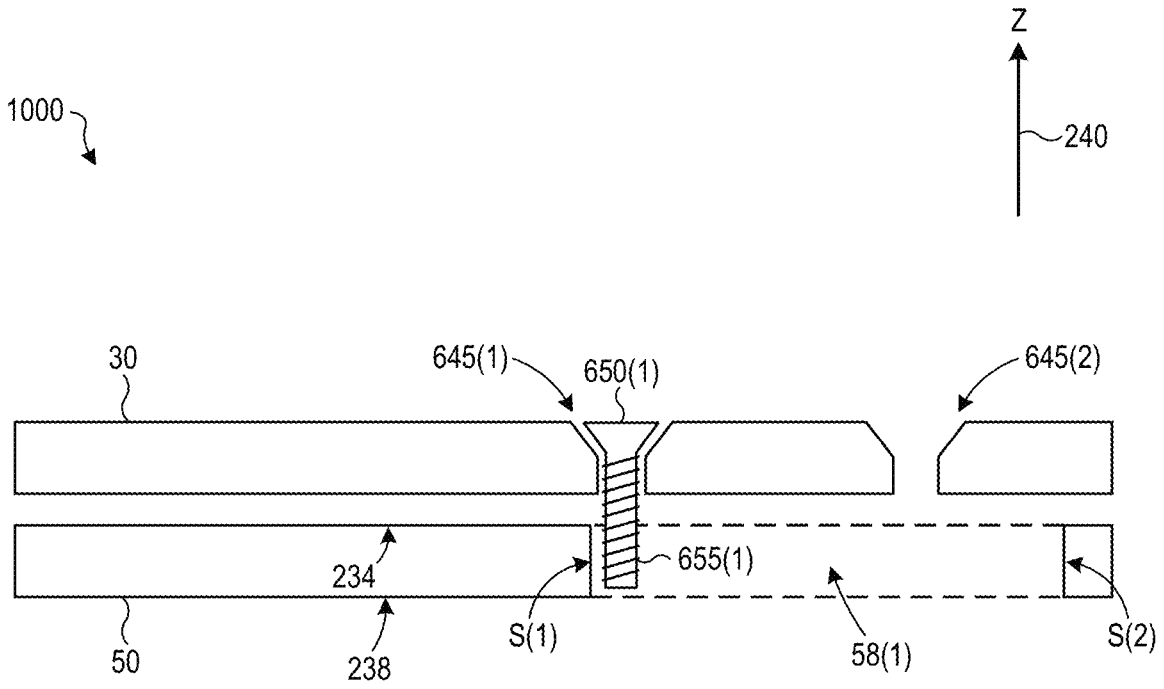
FIG. 10 is a cut-away side view of the rotatable sports-board binding adapter of FIG. 1 showing how a first safety screw may be inserted into a first safety-screw hole to limit rotation of the rotatable plate of FIG. 1 with respect to the base plate of FIG. 1, in an embodiment.
Figure 11:
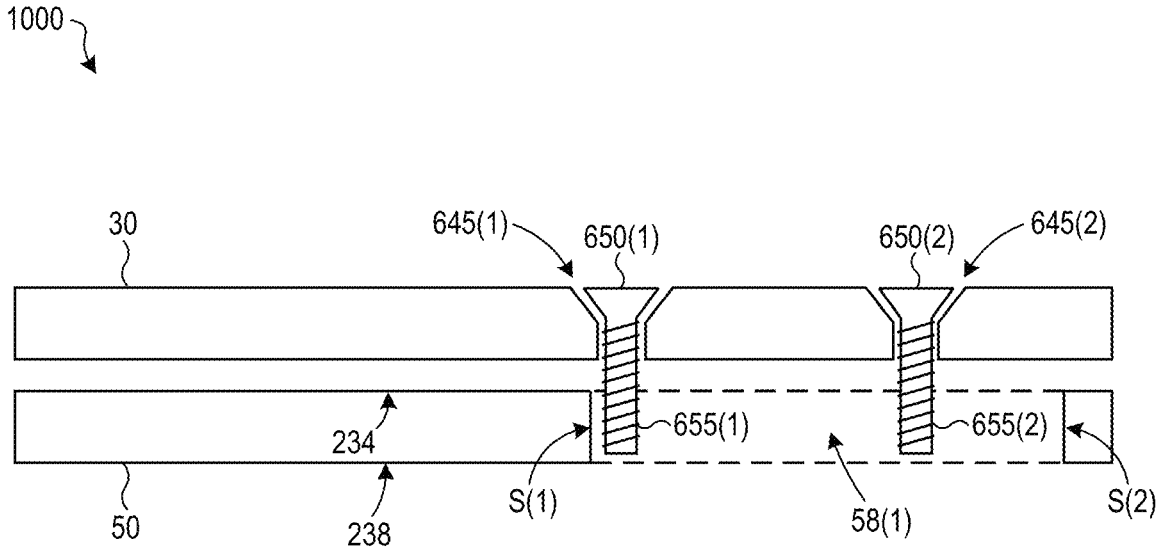
FIG. 11 shows the cut-away side view of FIG. 10 with a second safety screw inserted into a second safety-screw hole to further limit rotation of the rotatable plate of FIG. 1 with respect to the base plate of FIG. 1, in an embodiment.
Figure 12:
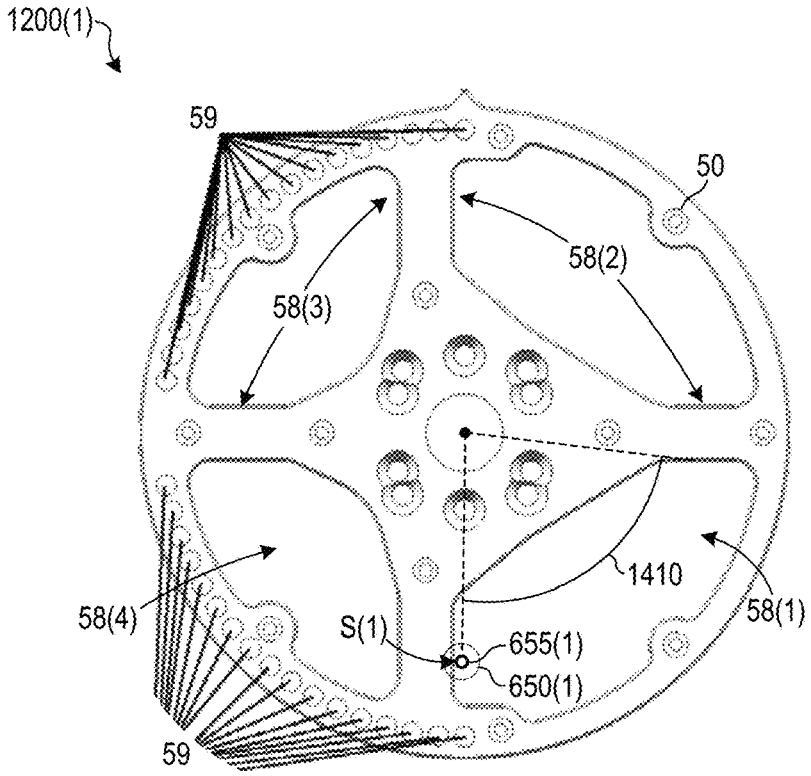
FIG. 12 shows first and second top views of the base plate of FIG. 1, illustrating one example of how a first safety-screw shaft of the first safety screw of FIG. 10, when inserted into the first safety-screw hole of FIG. 10, limits rotation of the rotatable plate of FIG. 1 with respect to the base plate, in an embodiment.
Figure 12:
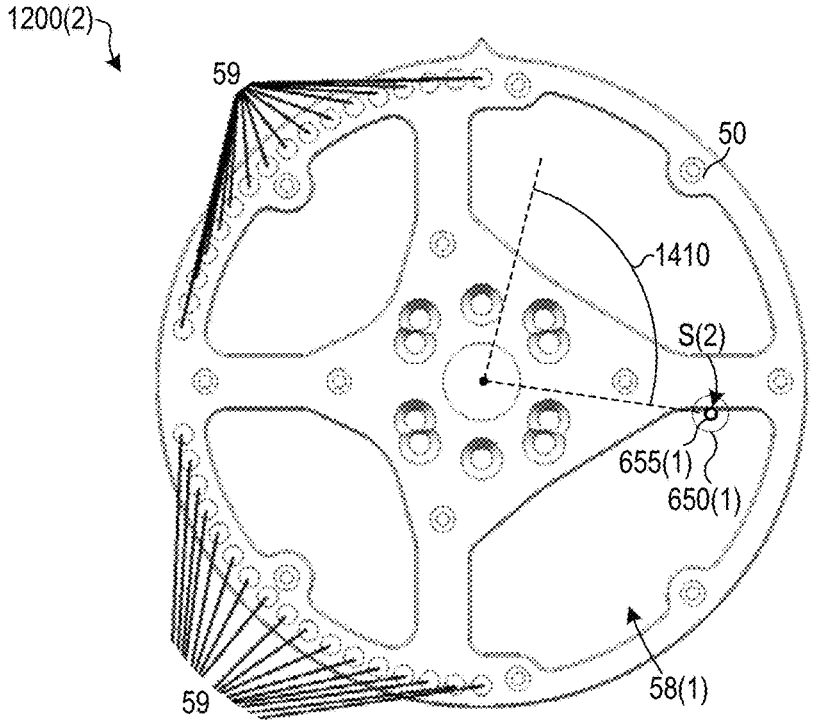
Figure 13:
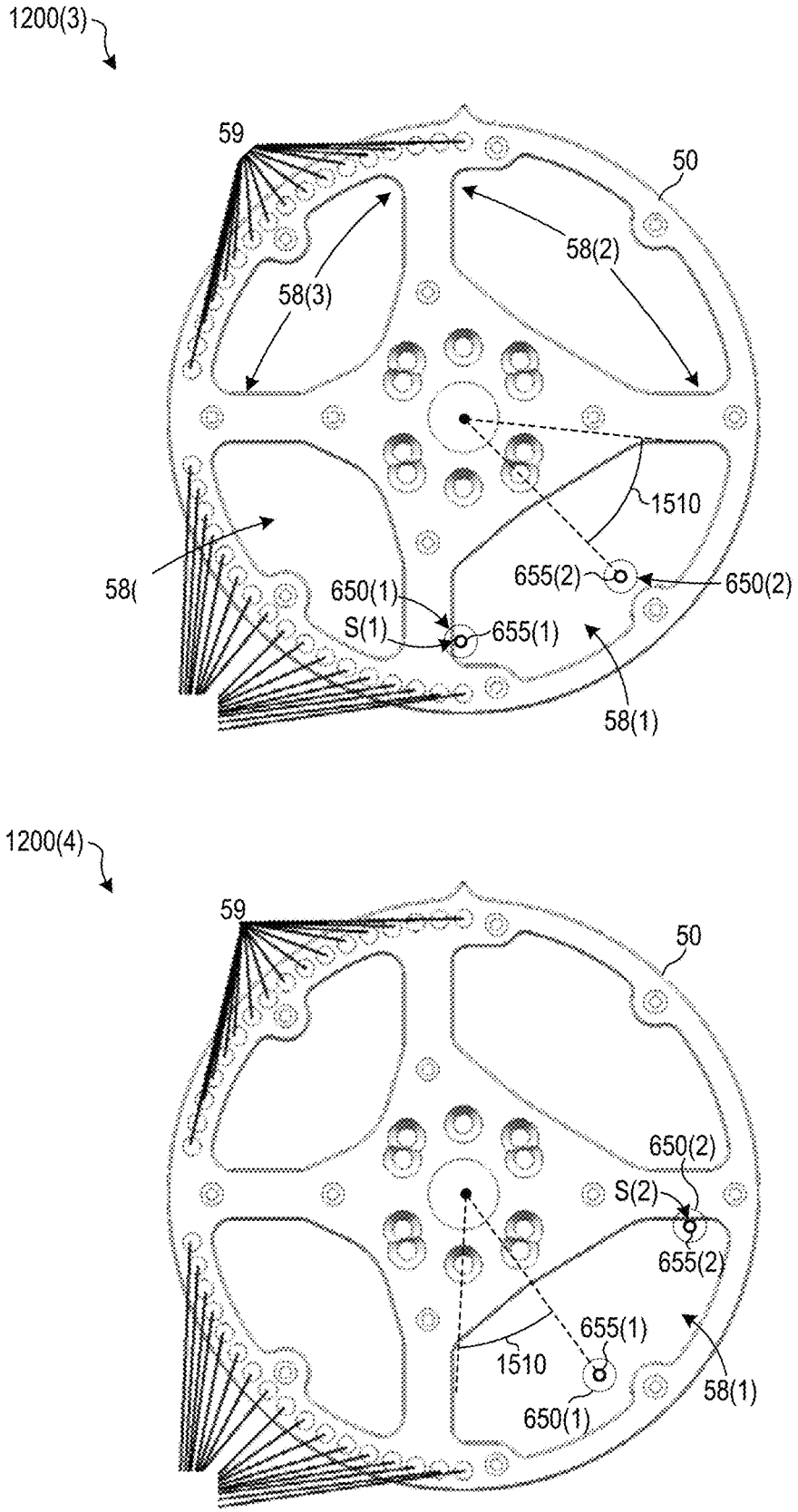
FIG. 13 shows third and fourth top views of the base plate of FIG. 1, illustrating one example of how a second safety-screw shaft of the second safety screw of FIG. 11, when inserted into the second safety-screw hole of FIG. 11, further limits rotation of the rotatable plate of FIG. 1 with respect to the base plate, in an embodiment.

FIG. 9 is a top view of rotatable plate 30 showing one example of how rotatable plate 30 forms a plurality of safety-screw holes 645. FIG. 10 is a cut-away side view 1000 of rotatable sports-board binding adapter 5 showing how a first safety screw 650(1) may be inserted into a first safety-screw hole 645(1) to limit rotation of rotatable plate 30 with respect to base plate 50. FIG. 11 shows cut-away side view 1000 of FIG. 10 with a second safety screw 650(2) inserted into a second safety-screw hole 645(2) to further limit rotation of rotatable plate 30 with respect to base plate 50. FIG. 12 shows first and second top views 1200(1), 1200(2) of base plate 50, illustrating one example of how a first safety-screw shaft 655(1) of first safety screw 650(1), when inserted into first safety-screw hole 645(1), limits rotation of rotatable plate 30 with respect to base plate 50. FIG. 13 shows third and fourth top views 1200(3), 1200(4) of base plate 50, illustrating one example of how a second safety-screw shaft 655(2) of second safety screw 650(2), when inserted into second safety-screw hole 645(2), further limits rotation of rotatable plate 30 with respect to base plate 50. FIGS. 9-13 are best viewed together with the following description.

In FIG. 9, rotatable plate 30 forms safety-screw holes 645 such that each of safety-screw holes 645 accepts one safety screw 650. For example, each of safety-screw holes 645 may be tapped, wherein safety screw 650 may be screwed into said each of safety-screw holes 645. Safety-screw holes 645 are positioned equidistant from a center 690 of rotatable plate 30, and each pair of neighboring safety-screw holes 645 is separated by an angle 1310. While FIG. 9 shows neighboring safety-screw holes 645 separated by an angle 1310 of 15°, neighboring safety-screw holes 645 may be separated by any angle without departing from the scope hereof. While FIG. 9 shows rotatable plate 30 forming five safety-screw holes 645, rotatable plate 30 may form any number of safety-screw holes 645 without departing from the scope hereof.

As shown in FIGS. 10 and 11, rotatable plate 30 further forms each of safety-screw holes 645 such that for each safety screw 650 inserted therein, a safety-screw shaft 655 of said each safety screw 650 extends downward from rotatable plate 30 into a passageway 58(1) formed by base plate 50. Thus, a length of safety screws 650(1) and 650(2) along z-direction 240 is chosen such that a bottom of safety screws 650(1) and 650(2) extends below top surface 234 of base plate 50, and above bottom surface 238 of base plate 50.

In first top view 1200(1) of FIG. 12, first safety-screw shaft 655(1) contacts a first travel limit S(1) of passageway 58(1). In second top view 1200(2) of FIG. 12, first safety-screw shaft 655(1) contacts a second travel limit S(2) of passageway 58(1). As rotatable plate 30 rotates with respect to base plate 50, safety-screw shaft 655(1) moves within passageway 58(1) between travel limits S(1) and S(2). Thus, first safety screw 650(1) limits rotation of rotatable plate 30 to a rotation range 1410 defined by travel limits S(1) and S(2). For clarity, rotatable plate 30 is not shown in FIG. 12.

In the example of FIG. 12, base plate 50 forms passageway 58(1) such that travel limits S(1) and S(2) define rotation range 1410 to be approximately 85°. However, base plate 50 may form passageway 58(1) such that travel limits S(1) and S(2) define rotation range 1410 to have a different value (e.g., greater than 85°, or less than 85°). While FIG. 12 shows base plate 50 forming four passageways 58, base plate 50 may form any number of passageways 58. While FIG. 12 shows safety-screw shaft 655(1) within passageway 58(1), rotatable plate 30 may be configured such that safety-screw shaft 655(1) extends downward into, and moves within, any other of passageways 58.

In third top view 1200(3) of FIG. 13, first safety-screw shaft 655(1) contacts first travel limit S(1) of passageway 58(1). In fourth top view 1200(4) of FIG. 13, second safety-screw shaft 655(2) contacts second travel limit S(2) of passageway 58(1). As rotatable plate 30 rotates with respect to base plate 50, both safety-screw shafts 655(1) and 655(2) move within passageway 58(1) between travel limits S(1) and S(2). Thus, safety screws 650(1) and 650(2) cooperate to limit rotation of rotatable plate 30 to a rotation range 1510. For clarity, rotatable plate 30 is not shown in FIG. 13.

Use of two safety screws 650 advantageously allows rotation range 1510 of FIG. 13 to be set less than rotation range 1410 of FIG. 12. Advantageously, safety screws 650 are configured for disengagement from rotatable plate 30 and re-engagement with rotatable plate 30 without disconnecting rotatable plate 30 from base plate 50 and without removing base plate 50 from sports board 70. Thus, a user may easily increase or decrease rotation range 1510 by changing which of safety-screw holes 645 are used with first and second safety screws 650(1), 650(2).

Figure 14:
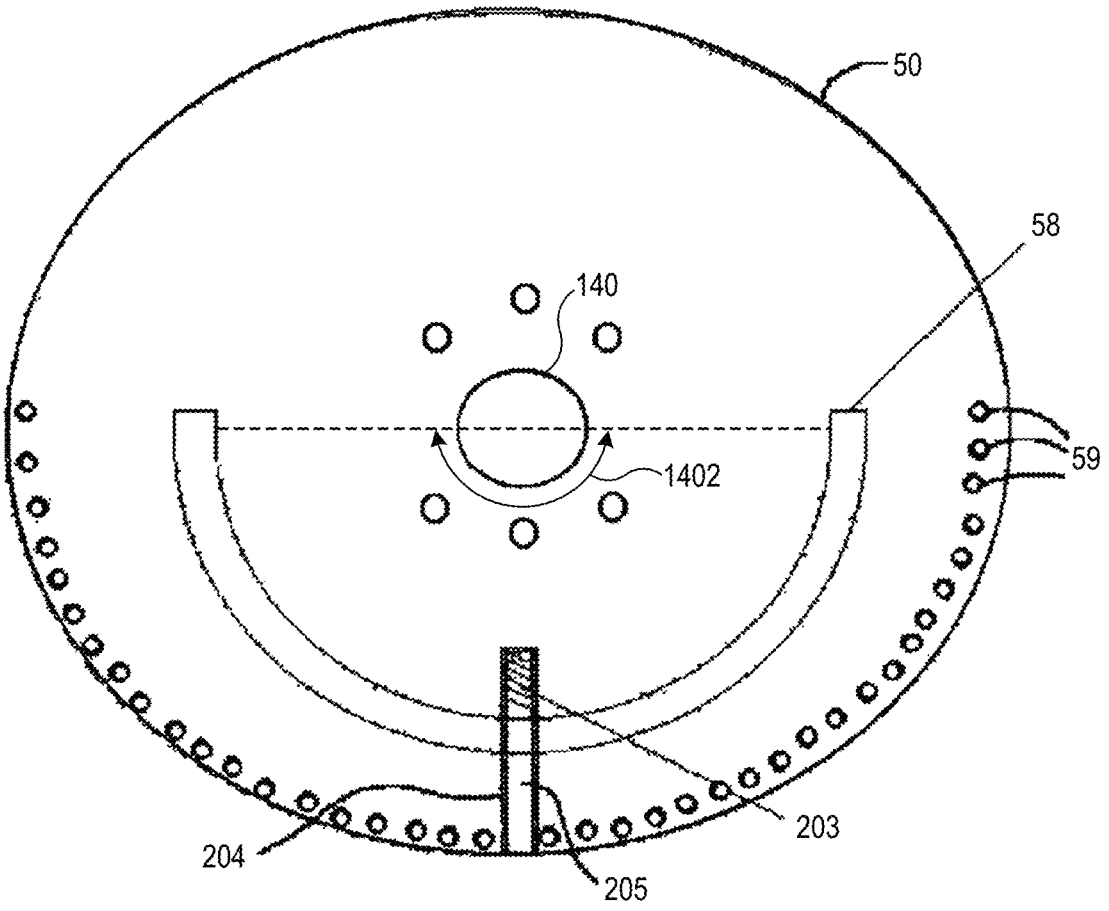
FIGS. 14 and 15 are top and perspective views, respectively, of the base plate of FIG. 1, illustrating one example of how the base plate forms a slot and an arc-shaped passageway in which one safety screw moves to limit rotation of the rotatable plate of FIG. 1 with respect to the base plate, in an embodiment.
Figure 15:
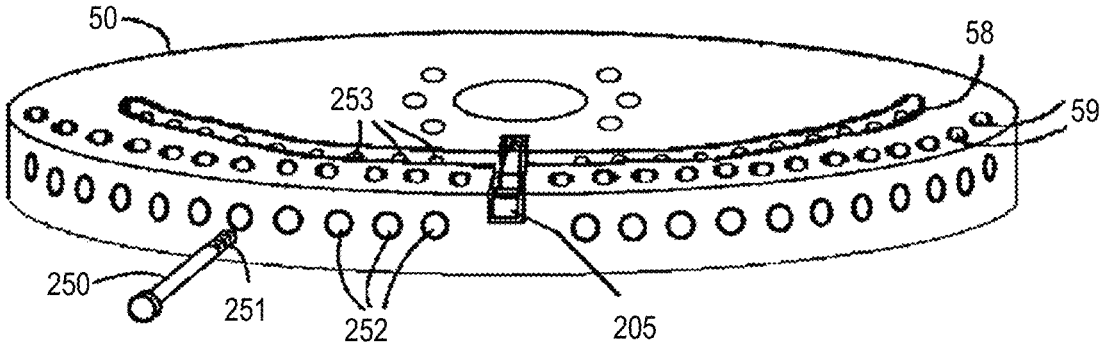

As another example of how embodiments herein may limit the angle through which binding 60 may rotate relative to sports board 70, FIG. 1 shows a rotation-limiting stop 205 positionable within a slot 204 formed by base plate 50. FIGS. 14 and 15 are top and perspective views, respectively, of base plate 50, illustrating one example of how base plate 50 forms slot 204 and an arc-shaped passageway 58 in which one safety screw 650 moves to limit rotation of rotatable plate 30 with respect to base plate 50. FIGS. 1, 14, and 15 are best viewed together with the following description.

Arc-shaped passageway 58 has two ends that act as travel stops to define a rotation range 1402 of rotatable plate 30 with respect to base plate 50. In FIGS. 1, 14, and 15, arc-shaped passageway 58 is symmetric about cylindrical post 140, wherein rotation range 1402 is 180°. Arc-shaped passageway 58 may extend partially or completely through base plate 50 (i.e., along z-direction 240) without departing from the scope hereof. Stop 205 may include a stop ridge 202 and a groove 201 that has approximately the same width as arc-shaped passageway 58. Spring 203 biases stop 205 so that stop ridge 202 limits the travel of safety screw 650 within arc-shaped passageway 58. Safety screw 650, arc-shaped passageway 58 and stop ridge 202 of stop 205 thus cooperate to limit rotation of rotatable plate 30, relative to base plate 50, to rotation range 1410. Rotation range 1410 corresponds to an arc within which safety screw 650 moves before reaching a travel limit formed by stop ridge 202 or one of the two ends of arc-shaped passageway 58.

In one embodiment. stop 205 may be pushed in so that groove 201 aligns with arc-shaped passageway 58, allowing safety screw 650 to pass over groove 201 so that safety screw 650 can move from one portion of arc-shaped passageway 58 to another portion. This may be used, for example, by a rental business, to select rotation range 1410 corresponding to a basic foot orientation (0-90 or 90-180°) that accommodates preferences of different users.

FIG. 15 shows how base plate 50 forms a series of angle holes 252 around a periphery of base plate 50. Angle holes 252 continue on the other side of arc-shaped passageway 58 as threaded mating holes 253. A rotation-limiting set screw 250 has end threads 251 that screw into one of mating holes 253 so that rotation-limiting set screw 250 protrudes across passageway 58, creating an additional travel limit for safety screw 650. One or more rotation-limiting set screws 250 may thus be used to further reduce rotation range 1410 through which rotatable plate can rotate relative to base plate 50.

Locking Mechanisms

FIG. 1 also shows one example locking mechanism 120 having a locking shaft 95 that engages one of a set of lock holes 59 formed by base plate 50. Locking mechanism 120 is "locked" when locking shaft 95 engages with one of lock holes 59 to prevent rotatable plate 30 from rotating with respect to base plate 50, thus holding binding 60 stationary with respect to sports board 70 at an angle defined by said one of lock holes 59. Locking mechanism 120 is "unlocked" when locking shaft 95 is free from lock holes 59, allowing the user to rotate their foot. Certain users may value the convenience of allowing rotatable plate 30 to rotate without limitation, and thus may choose to detach the one or more safety screws 650. Advantageously, with locking mechanism 120 unlocked and all safety screws 650 removed, a user may perform stunts. For example, if the back foot of the user is not attached, the user can rotate the snowboard 360° while in the air.

As shown in FIG. 1, locking mechanism 120 may have an "L-shaped" lever 122 to facilitate grasping by a user. A cord or handle 300 with a hand grip or a leg strap, such as, for example, a top end loop 303, may also attach to lever 122 by a bottom hook 302 and a top ring 301 so that the user may grasp cord 300 to operate lever 122 from a standing position. Other configurations for attaching cords and/or handles to lever 122 may be used without departing from the scope hereof.

Figure 17:
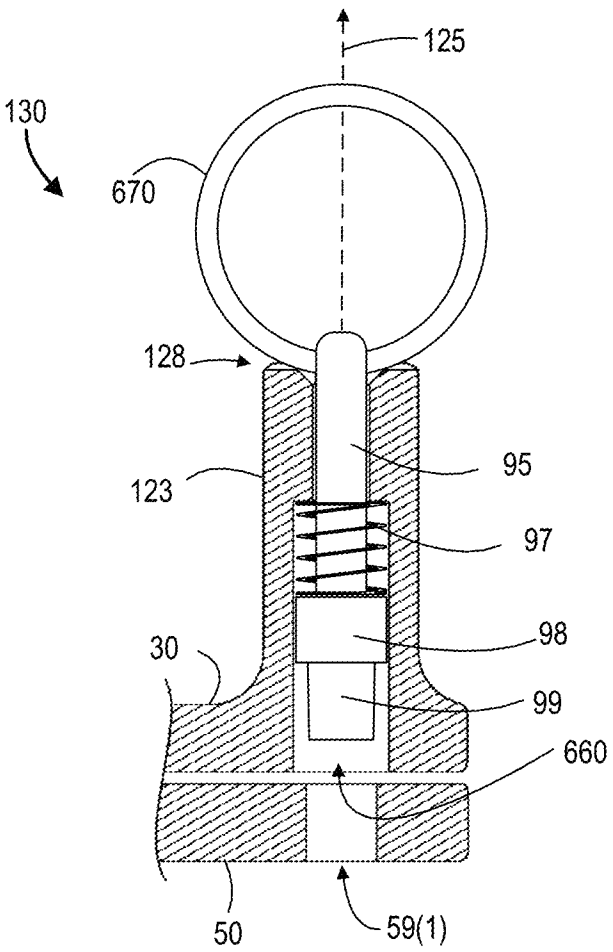
FIGS. 16 and 17 are cross-sectional views of one example locking mechanism similar to a locking mechanism of FIG. 1, in an embodiment.
Figure 16:
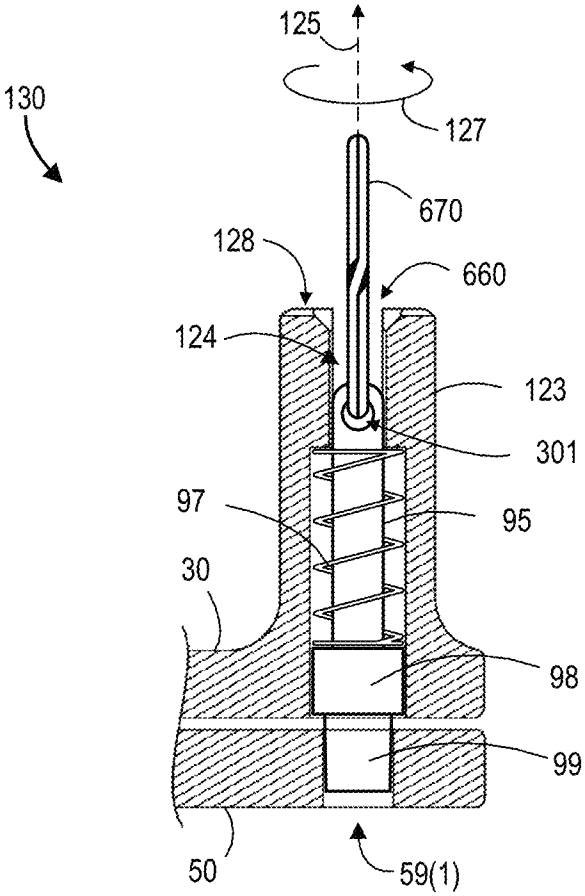

FIGS. 16 and 17 are cross-sectional views of one example locking mechanism 130 similar to locking mechanism 120 of FIG. 1. FIGS. 16 and 17 show locking mechanism 130 in locked and unlocked configurations, respectively. Each of FIGS. 16 and 17 shows a portion of rotatable plate 30 that includes an outer sleeve 123, and a portion of base plate 50 that includes one lock hole 59(1) of lock holes 59. Similar to locking mechanism 120, locking mechanism 130 includes locking shaft 95 (including a flange 98 and a tip 99) that moves through outer sleeve 123 to engage lock hole 59(1), and a spring 97 that biases shaft 95 downward. Outer sleeve 123 forms a passageway 660 within which shaft 95 may move linearly in both upward and downward directions (arrow 125 indicating the upward direction). Furthermore, shaft 95 may rotate within passageway 660, as indicated by arrow 127.

Unlike locking mechanism 120 of FIG. 1, locking mechanism 130 has a split ring 670. In FIG. 16, locking shaft 95 is rotated such that split ring 670 aligns with a slot 124 formed by outer sleeve 123. Spring 97 biases shaft 95 downward such that tip 99 engages lock hole 59(1), locking rotatable plate 30 at an angle, relative to base plate 50, determined by lock hole 59(1). The down position of locking shaft 95 shown in FIG. 16 may be used, for example, during downhill travel on a snowboard.

In FIG. 17, locking shaft 95 is positioned upward such that tip 99 of shaft 95 is disengaged from lock hole 59(1). To move locking shaft 95 from the down position shown in FIG. 16 into the up position shown in FIG. 17, a user first pulls split ring 670 upwards (e.g., in the direction of arrow 125), compressing spring 97 and raising split ring 670 above upper surface 128 of outer sleeve 123. The user then rotates split ring 670 (e.g., twists split ring 670 in the direction of arrow 127, or in the opposite direction) so that split ring 670 no longer aligns with slot 124, but rests upon an upper surface 128 of outer sleeve 123 instead. In the up position, rotatable plate 30 moves freely within the range of rotation allowed by the motion of one or more safety screws 650 within one of passageways 58 (see FIGS. 12 and 13). The up position may be used, for example, while a user of a snowboard pushes the snowboard along flat terrain, mounts or dismounts a chairlift, or wants to rotate their foot while riding the snowboard downhill. To move shaft 95 from the up position shown in FIG. 17 into the down position shown in FIG. 16, a user rotates rotatable plate 30 such that shaft 95 is over lock hole 59(1), and rotates split ring 670 so that it aligns with slot 124 of outer sleeve 123. Spring 97 then biases shaft 95 downward such that tip 99 engages lock hole 59(1).

While FIG. 1 shows lock holes 59 covering half a circumference of base plate 50, lock holes 59 may extend over a greater or lesser amount of the circumference of base plate 50. For example, lock holes 59 extending over the entire circumference of base plate 50 may provide flexibility for installers or rental businesses to mount base plate 50 in any orientation on sports board 70. Furthermore, rotatable sports-board binding adapter 5 may have more than one locking mechanism 120 for improved mechanical integrity. For example, one such locking mechanism 120 can act as a backup should another locking mechanism 120 fail. Multiple locking mechanisms 120 may be placed adjacent to each other about the circumference of rotatable plate 30. Alternatively, locking mechanisms 120 may be placed away from each other; for example, two locking mechanisms 120 may be placed 180° from each other about the circumference of rotatable plate 30. The above arguments also apply to more than one locking mechanism 130, and/or combinations of locking mechanism 120 and locking mechanism 130.

In one embodiment, tip 99 of locking shaft 95 is tapered so that even when imperfectly centered over lock hole 59(1) (e.g., because of wear, and/or torque exerted on adapter 5) tip 99 can enter lock hole 59(1) and hold rotatable plate 30 securely as spring 97 biases shaft 95 downward into a fully seated position within lock hole 59(1).

Additional Embodiments

In one embodiment, rotatable plate 30 forms one or more information-bearing surfaces 31, as shown in FIG. 1. Information 32 on information-bearing surfaces may include, for example, advertising messages (e.g., product names, phone numbers, websites) or contact information (e.g., name, address, phone number) of an owner of sports board 70. Information 32 may be affixed to information-bearing surfaces 31 by any suitable means, such as writing, painting, affixing a label, imprinting, inscribing or molding information 32 thereon.

In another embodiment, rotatable sports-board binding adapter 5 includes a rotation angle pointer 500 that points to a current rotation angle on an angle scale 501 of sports board 70, as shown in FIG. 1. Pointer 500 may be formed on or adjacent to locking mechanism 120, for example. Angle scale 501 may be, for example, a sticker applied to sports board 70, or may be formed by writing, painting, imprinting, inscribing or molding angle information on sports board 70.

In another embodiment, base plate 50 includes a grease ring 600 that keeps dirt away from cylindrical post 140 between base plate 50 and rotatable plate 30, as shown in FIG. 1.

Figure 18:
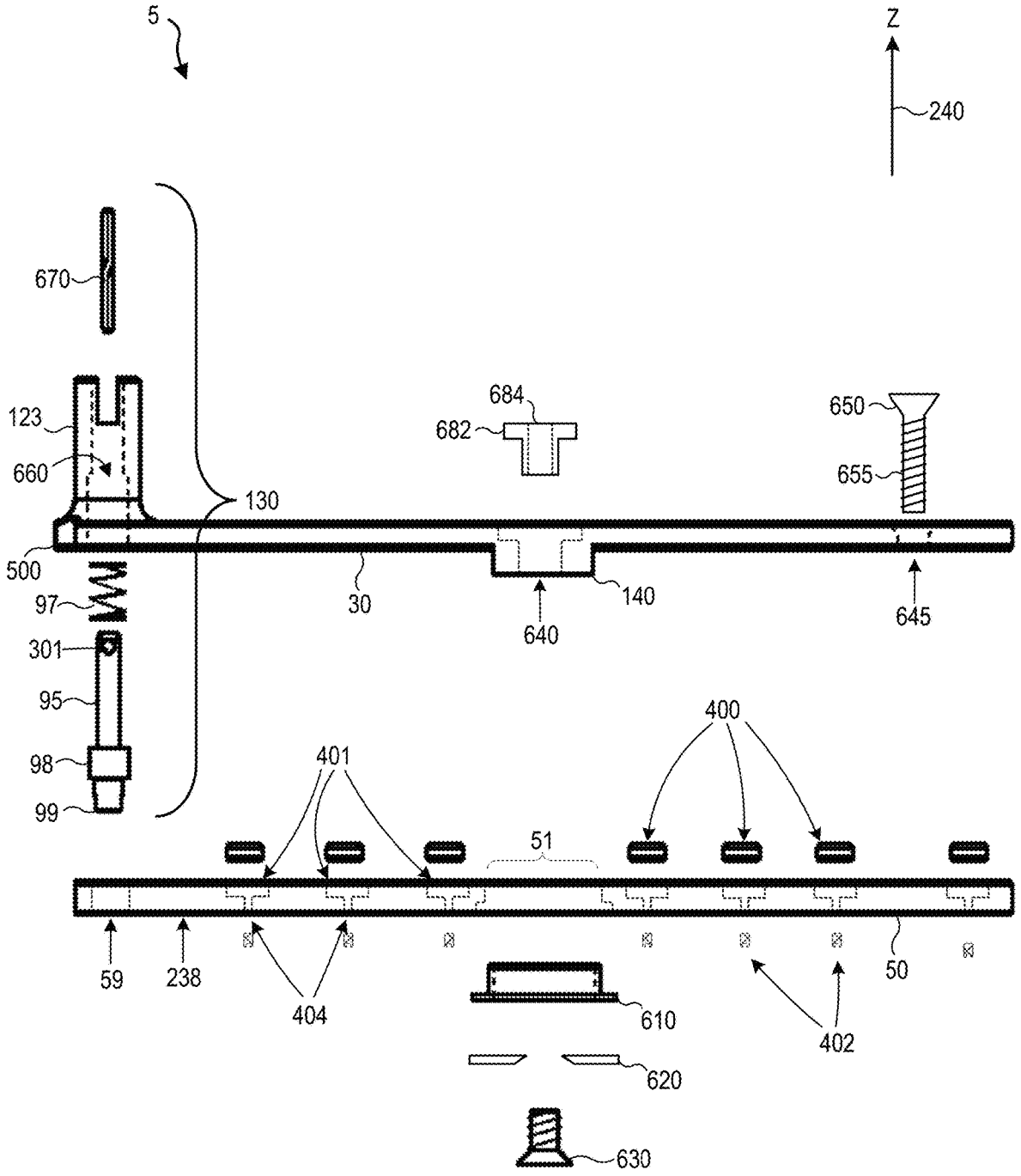
FIG. 18 is an exploded side view of the rotatable sports-board binding adaptor of FIG. 1, in embodiments.

FIG. 18 is an exploded side view of rotatable sports-board binding adapter 5 of FIG. 1. FIG. 18 shows how base plate 50 and rotatable plate 30 rotatably connect when cylindrical post 140 is inserted into mating circular opening 51 formed by base plate 50. A screw 630 extends through a washer 620, circular opening 51, and an opening 640 formed by rotatable plate 30 to engage a threaded hole 684 formed by an insert 682. When screw 630 and insert 682 are formed from steel and rotatable plate 30 is formed from aluminum, insert 682 advantageously secures rotatable plate 30 and base plate 50 together more securely as compared to the case of screw 630 engaging a threaded hole formed by rotatable plate 30. Insert 682 is strong enough to secure rotatable plate 30 and base plate 50 together in the presence of an excessive force (e.g., a crash) that could cause steel screw 630 to be pulled out of a threaded hole formed by aluminum rotatable plate 30.

In FIG. 18, rotatable plate 30 forms opening 640 such that insert 682 is flush with a top face of rotatable plate 30 when rotatable plate 30 is secured to base plate 50. A low-friction bushing 610 fits about cylindrical post 140 and reduces friction between base plate 50, washer 620, and cylindrical post 140. Base plate 50 forms circular opening 51 such that washer 620 and screw 630 are flush with bottom face 238 of base plate 50 when rotatable plate 30 is secured to base plate 50.

Figure 19:
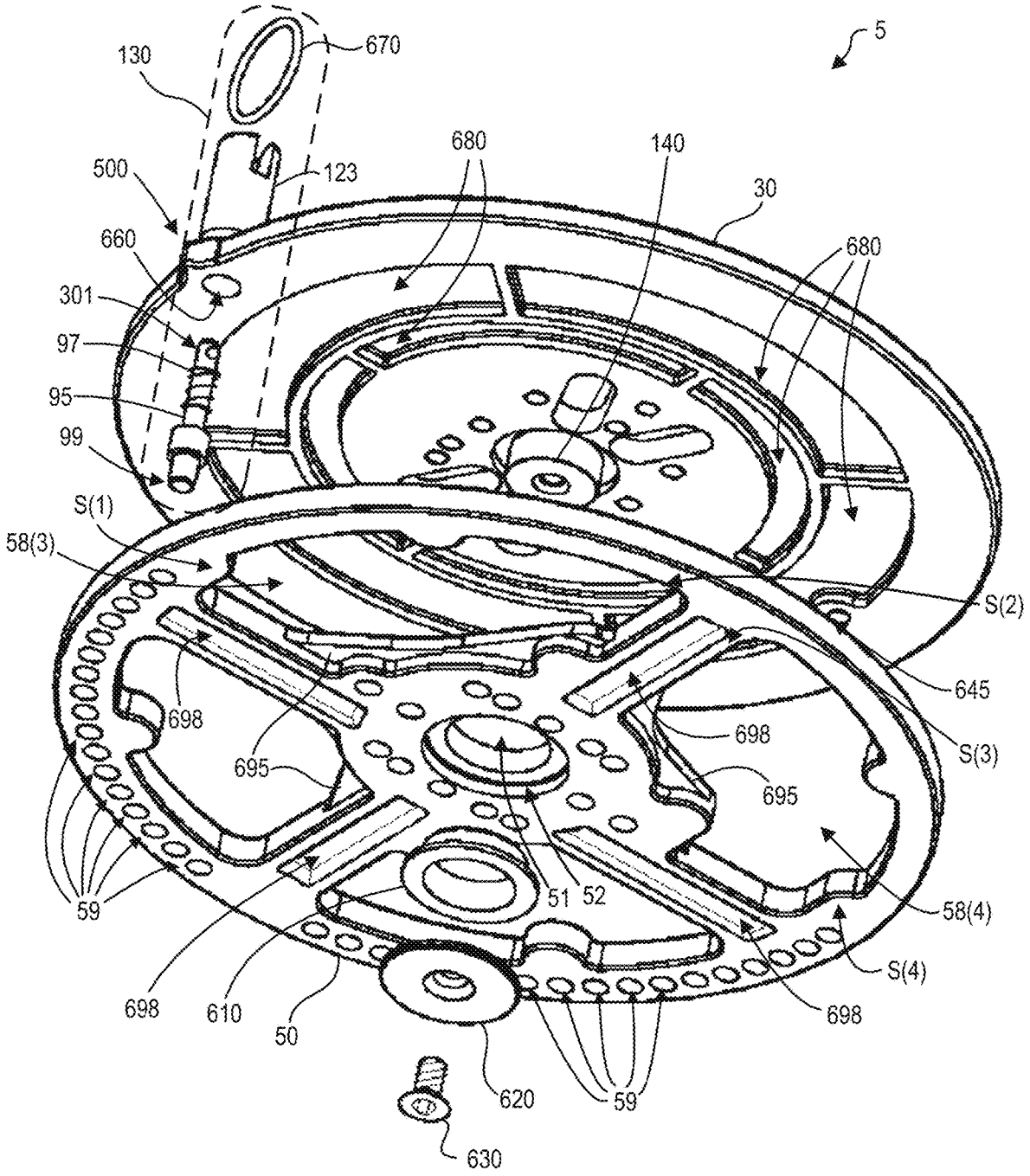
FIG. 19 is an exploded perspective view of the rotatable sports-board binding adapter of FIG. 1, in embodiments.

FIG. 19 is an exploded perspective view of rotatable sports-board binding adapter 5 of FIG. 1. Base plate 50 forms passageways 58(3) and 58(4) within which safety screw 650 (see FIGS. 12 and 13) can move as rotatable plate 30 rotates. Base plate 50 thus sets travel limits for safety screw 650 at points labeled S(1)-S(4). For example, points S(1) and S(2) limit rotation of rotatable plate 30 to one specific arc of about 90° with respect to base plate 50, while S(3) and S(4) limit rotation of rotatable plate 30 to a different arc of about 90° with respect to base plate 50. It should be appreciated that base plate 50 may be configured to form travel limits for other angles, and lock holes 59 may be placed to allow rotatable plate 30 to lock to base plate 50 in specific orientations within the travel limits (see FIGS. 21-23).

In one embodiment, base plate 50 includes flanges 695 to increase strength of base plate 50. In another embodiment, base plate 50 forms recesses 698 to reduce weight of base plate 50. In another embodiment, rotatable plate 30 forms recesses 680 to reduce weight. Flanges 695 and recesses 680 and 698 may be configured differently than illustrated in FIG. 19 without departing from the scope hereof.

Figure 20:
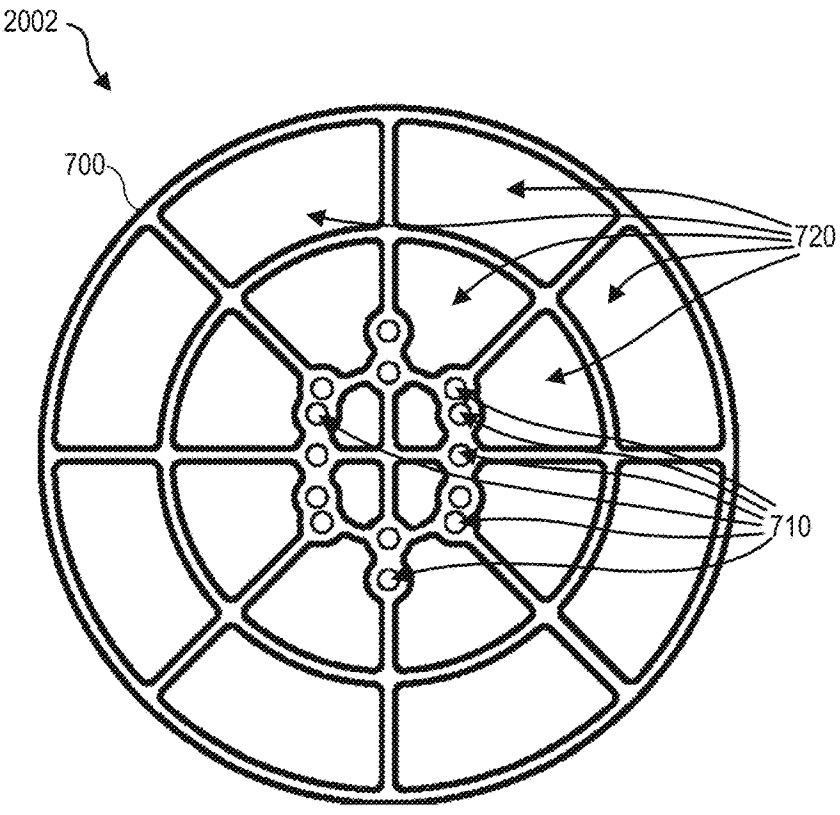
FIG. 20 shows a top view and a bottom view of one example sports-board binding mounting plate, in an embodiment.
Figure 20:
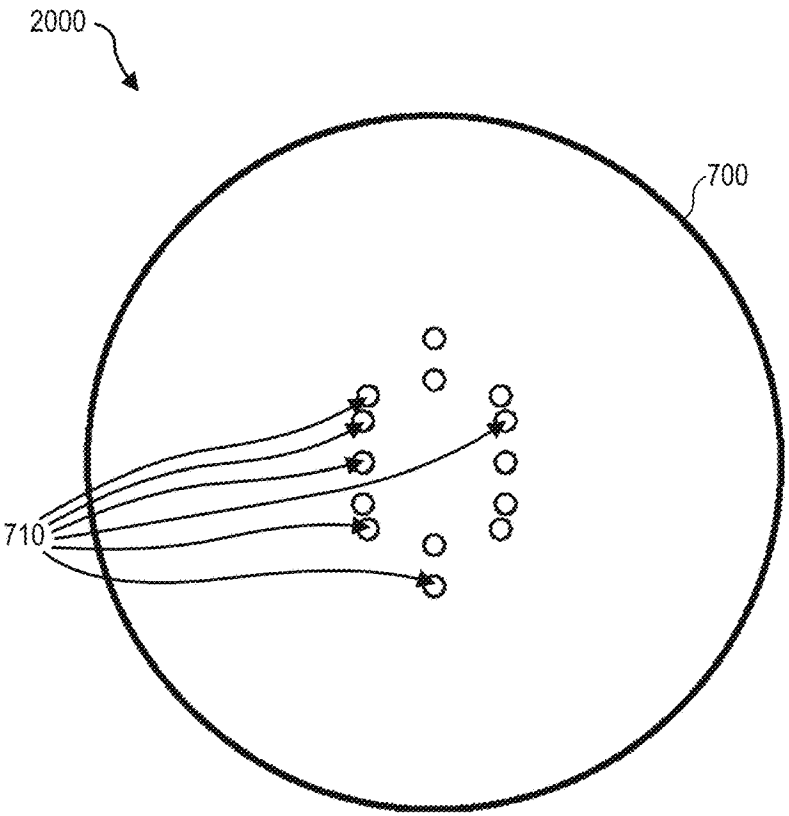

FIG. 20 shows a top view 2000 and a bottom view 2002 of one example sports-board binding mounting plate 700. Plate 700 has mounting holes 710 for mounting a binding (e.g., binding 60 of FIG. 1) to plate 700 and for mounting plate 700 to a sports board (e.g., sports board 70 of FIG. 1). In the example of FIG. 20, plate 700 has recesses 720 that extend only partially through plate 700, thereby reducing weight of plate 700 as compared to a plate 700 that does not have recesses 720. Plate 700 may be made, for example, of a non-rusting, durable material, such as metal (e.g., stainless steel, die cast aluminum), structurally durable molded or injected plastic, carbon fiber composite, or combinations thereof (e.g., plastic molded about a metal frame).

Plate 700 may have a thickness that matches a thickness of rotatable sports-board binding adapter 5, and may be used as a fixed mounting plate for attaching one binding to sports board 70, while one rotatable sports-board binding adapter 5 is used to attach a second binding to sports board 70. For example, an owner of sports board 70 may mount a front binding to sports board 70 using adapter 5 so that he or she can (1) disengage rotatable plate 30 from base plate 50 (i.e., locking mechanism 120, 130 is unlocked) and release his or her foot from a rear binding during activities such as pushing sports board 70 along flat terrain, or riding a chairlift, and (2) engage rotatable plate 30 to base plate 50 (i.e., locking mechanism 120, 130 is locked) at other times, and attach his or her foot to the rear binding at a fixed angle, with both bindings mounted at the same height above sports board 70. Alternatively, an owner of sports board 70 may mount two bindings to sports board 70 using two adapters 5 (for example, a rental business may wish to change the rotation angle of both bindings, to accommodate some users who use a "right-footed" orientation and other users who use a "left-footed" orientation).

Example Usage

Figure 21:
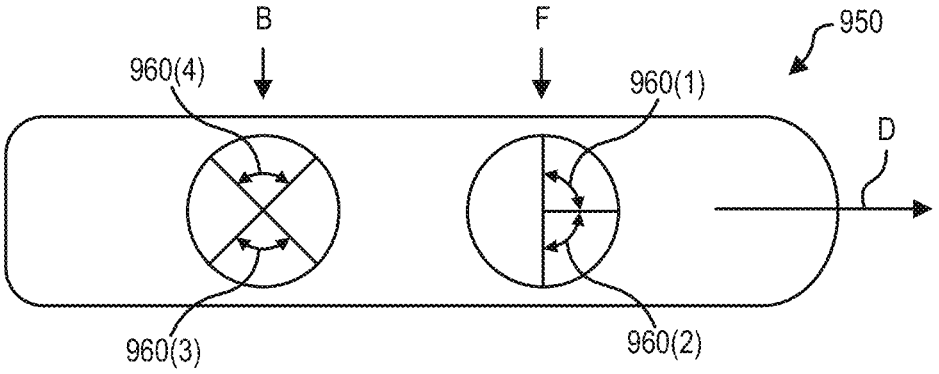
FIG. 21 illustrates ranges of rotation that may be implemented on a snowboard by utilizing the rotatable sports-board binding adapter of FIG. 1 and/or the sports-board binding mounting plate of FIG. 20, in an embodiment.

FIG. 21 illustrates ranges of rotation 960(1)-960(4) that may be implemented on a snowboard 950 by utilizing rotatable sports-board binding adapter 5 and/or sports-board binding mounting plate 700. Snowboard 950 is one example of sports board 70 of FIG. 1. Snowboard 950 has mounting areas denoted F and B for a front boot and a back boot, respectively. Snowboard users generally prefer their front boot at an angle of 90° or less relative to a forward direction D in which the snowboard moves, and their back boot pointing toward the same side of the snowboard as the front boot. Different styles of use may be facilitated by different offsets between the angles of the front and back boots (see FIGS. 22 and 23). A user who uses his or her right foot forward may prefer to utilize, for example, range of rotation 960(1) for the front boot, and range of rotation 960(4) for the back boot. A user who uses his or her left foot forward may prefer to utilize, for example, range of rotation 960(2) for the front boot, and range of rotation 960(3) for the back boot. If the user does not wish to change back boot orientation, he or she may utilize one rotatable sports-board binding adapter 5 for the front boot (so that the front foot can be rotated into forward direction D for pushing along flats and for mounting and dismounting chairlifts) and one sports-board binding mounting plate 700 for the back boot. If the user wishes to change back boot orientation, one rotatable sports-board binding adapter 5 may be utilized for each of the front boot and the back boot.

Figure 22:
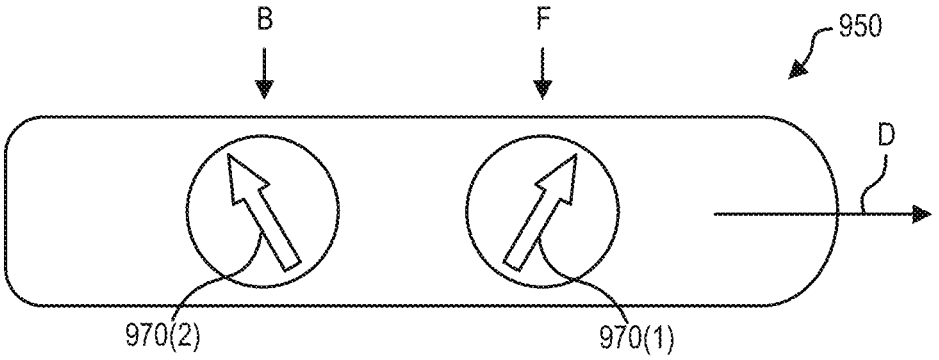
FIG. 22 illustrates boot orientations for a typical, recreational snowboard user who places his or her right foot towards the front of the snowboard of FIG. 21.

FIG. 22 illustrates boot orientations for a typical, recreational snowboard user who places his or her right foot towards the front of snowboard 950. Arrow 970(1) denotes the right foot orientation from heel to toe, and is at about a 60° angle with respect to forward direction D. Arrow 970(2) denotes the left foot orientation from heel to toe, and is at about a 60° angle with respect to arrow 970(1), or a 120° angle with respect to forward direction D. Many recreational snowboard users utilize this type of stance, that is, with the boots pointing outwards from each other and the back boot facing slightly backwards with respect to forward direction D. Comparing the orientations shown in FIG. 22 to the ranges of rotation illustrated in FIG. 21, it may be seen that arrow 970(1) points in a direction within range of rotation 960(1) and that arrow 970(2) points in a direction within range of rotation 960(4).

Figure 23:
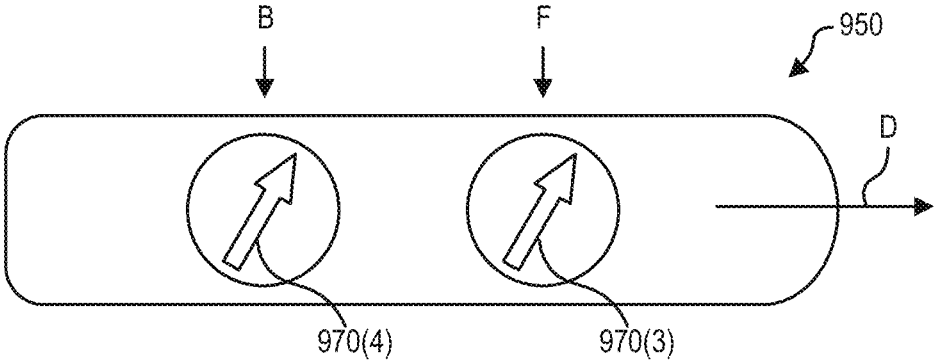
FIG. 23 illustrates boot orientations for a snowboard racer who places his or her right foot towards the front of the snowboard of FIG. 21.

FIG. 23 illustrates boot orientations for a snowboard racer who places his or her right foot towards the front of snowboard 950. Arrow 970(3) denotes the right foot orientation from heel to toe, and is at about a 60° angle with respect to forward direction D. Arrow 970(4) denotes the left foot orientation from heel-to-toe, and is parallel to arrow 970(3). Many snowboard racers utilize this type of stance, that is, with the boots pointing approximately parallel to each other and both boots facing slightly forward of perpendicular with respect to forward direction D. Comparing the orientations shown in FIG. 23 to the ranges of rotation illustrated in FIG. 21, it may be seen that arrow 970(3) points in a direction within range of rotation 960(1) and that arrow 970(4) points in a direction within range of rotation 960(4). Therefore, a user who prefers a racing stance at times and a recreational stance at other times can adjust between the two stances by utilizing rotatable sports-board binding adapter 5 to adjust the orientation of the back boot.

Methods

Figure 24:
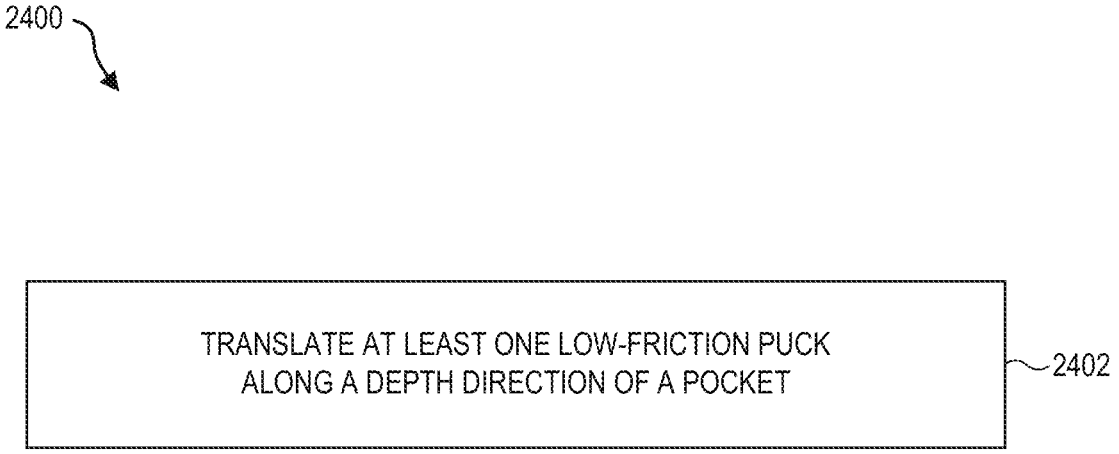
FIG. 24 shows one example of a method that adjusts friction of a rotatable sports-board binding adapter, in embodiments.

FIG. 24 shows one example of a method 2400 that adjusts friction of a sports-board binding adapter. In a block 2402 of method 2400, at least one low-friction puck is translated along a depth direction of a pocket, formed by a base plate and containing said at least one low-friction puck, to force a top face of said at least one low-friction puck against a plate rotatably connected to the base plate. In one embodiment, translating comprises rotating a puck set screw in a threaded hole formed by the base plate beneath the pocket to push the puck set screw against a bottom face of the low-friction puck. In one example of step 2402, Allen key 228 of FIG. 4 is rotated about rotation axis 442 of set screw 402(1) to advance set screw 402(1) along z-direction 240, thereby pushing puck 400(1) against bottom surface 212 of rotatable plate 30.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A rotatable sports-board binding adapter, comprising:

a base plate forming a pocket sized to accommodate a low-friction puck; and a rotatable plate connected to the base plate and operable to rotate about a rotation axis;

the low-friction puck, when inserted into the pocket, being translatable along a depth direction, parallel to the rotation axis, of the pocket to contact the rotatable plate and slide against the rotatable plate when the rotatable plate rotates.

2. The rotatable sports-board binding adapter of claim 1, the base plate being further configured to be affixed to a sports board, the rotatable plate being further configured to receive a binding.

3. The rotatable sports-board binding adapter of claim 1, the base plate forming a threaded hole beneath the pocket such that a tip of a puck set screw translatable along the threaded hole contacts a bottom face of the low-friction puck to push the top face of the low-friction puck against the rotatable plate.

4. The rotatable sports-board binding adapter of claim 1, further comprising the low-friction puck disposed in the pocket such that a top face of the low-friction puck contacts the rotatable plate.

5. The rotatable sports-board binding adapter of claim 4, the threaded hole being a through hole, and further comprising the puck set screw, a head of the puck set screw being accessible through the threaded hole.

6. The rotatable sports-board binding adapter of claim 4, further comprising the puck set screw, which is unattached to the low-friction puck.

7. The rotatable sports-board binding adapter of claim 4, the low-friction puck being sized and positioned such that the base plate and the rotatable plate are free from direct contact.

8. The rotatable sports-board binding adapter of claim 1, wherein the base plate forms a passageway defining first and second travel limits; and further comprising a safety screw having a shaft that extends downward from the rotatable plate into the passageway and moves within the passageway when the rotatable plate rotates;

wherein the shaft of the safety screw limits rotation of the rotatable plate relative to the base plate when contacting one of the first and second travel limits.

9. The rotatable sports-board binding adapter of claim 8, the safety screw being configured for disengagement from the rotatable plate and re-engagement with the rotatable plate without disconnecting the rotatable plate from the base plate and without removing the base plate from the sports board.

10. The rotatable sports-board binding adapter of claim 8, the rotatable plate forming a safety-screw hole that receives the safety screw.

11. The rotatable sports-board binding adapter of claim 1, wherein the base plate forms a passageway defining first and second travel limits; and further comprising first and second safety screws, each having a shaft that extends downward from the rotatable plate into the passageway, and that moves within the passageway when the rotatable plate rotates;

wherein the shaft of each of the first and second safety screws limits rotation of the rotatable plate when contacting the first and second travel limits, respectively.

12. The rotatable sports-board binding adapter of claim 11, each of the first and second safety screws being configured for disengagement from the rotatable plate and re-engagement with the rotatable plate without disconnecting the rotatable plate from the base plate and without removing the base plate from the sports board.

13. The rotatable sports-board binding adapter of claim 11, the rotatable plate forming first and second safety-screw holes that receive the first and second safety screws, respectively.

14. The rotatable sports-board binding adapter of claim 13, the first and second travel limits defining a first rotation range of the rotatable plate with respect to the base plate; and the rotatable plate forming the first and second safety-screw holes such that the shafts of the first and second safety screws, when inserted into the respective first and second safety-screw holes, limit rotation of the rotatable plate to a second rotation range less than the first rotation range.

15. The rotatable sports-board binding adapter of claim 14, the rotatable plate forming a plurality of safety-screw holes, each configured to receive one of the first and second safety screws such that the shafts of the first and second safety screws, when inserted into two of the plurality of safety-screw holes, limit rotation of the rotatable plate to the second rotation range.

16. A rotatable sports-board binding adapter, comprising:

a base plate; and a rotatable plate (i) connected to the base plate to rotate about a rotation axis, and (ii) forming a pocket configured to accommodate a low-friction puck;

the low-friction puck, when inserted into the pocket, being translatable along a depth direction, parallel to the rotation axis, of the pocket to contact the base plate and slide against the rotatable plate when the rotatable plate rotates.

17. The rotatable sports-board binding adapter of claim 16, further comprising the low-friction puck disposed in the pocket such that a bottom face of the low-friction puck contacts the base plate.

18. The rotatable sports-board binding adapter of claim 16, the rotatable plate forming a threaded hole above the pocket such that a tip of a puck set screw translatable along the threaded hole contacts a top face of the low-friction puck to push the bottom face of the low-friction puck against the base plate.

19. The rotatable sports-board binding adapter of claim 18, the threaded hole being a through hole, and further comprising the puck set screw, a head of the puck set screw being accessible through the threaded hole.

20. The rotatable sports-board binding adapter of claim 18, further comprising the puck set screw, which is unattached to the low-friction puck.

* * * * *